US011532417B2

(12) United States Patent
Imamura et al.

(10) Patent No.: US 11,532,417 B2
(45) Date of Patent: Dec. 20, 2022

(54) ELECTROMAGNETIC FORMING COIL UNIT AND FORMED-ARTICLE PRODUCING METHOD USING SAME

(71) Applicant: Kabushiki Kaisha Kobe Seiko Sho (Kobe Steel, Ltd.), Kobe (JP)

(72) Inventors: Yoshihaya Imamura, Fujisawa (JP); Takayoshi Sugisaki, Fujisawa (JP); Chieko Imai, Fujisawa (JP)

(73) Assignee: Kobe Steel, Ltd., Kobe (JP)

( * ) Notice: Subject to any disclaimer, the term of this patent is extended or adjusted under 35 U.S.C. 154(b) by 428 days.

(21) Appl. No.: 16/630,248

(22) PCT Filed: Jul. 12, 2018

(86) PCT No.: PCT/JP2018/026398
§ 371 (c)(1),
(2) Date: Jan. 10, 2020

(87) PCT Pub. No.: WO2019/013303
PCT Pub. Date: Jan. 17, 2019

(65) Prior Publication Data

US 2021/0090771 A1 Mar. 25, 2021

(30) Foreign Application Priority Data

Jul. 12, 2017 (JP) ..... JP2017-136636
Feb. 8, 2018 (JP) ..... JP2018-021085

(51) Int. Cl.
*H01F 27/24* (2006.01)
*H01F 27/28* (2006.01)
(Continued)

(52) U.S. Cl.
CPC ..... *H01F 7/081* (2013.01); *B21D 26/14* (2013.01); *H01F 27/24* (2013.01); *H01F 27/28* (2013.01)

(58) Field of Classification Search
CPC ..... H01F 7/081; H01F 27/24; H01F 27/28; H01F 7/20; B21D 26/14; B21D 39/08; B21D 39/06
See application file for complete search history.

(56) References Cited

U.S. PATENT DOCUMENTS

2003/0006761 A1* 1/2003 Hiramatsu ..... G01D 5/2291 324/207.16
2009/0103840 A1* 4/2009 Hibi ..... F16C 33/208 384/100
(Continued)

FOREIGN PATENT DOCUMENTS

JP 58-37051 B2 8/1983
JP 6-312226 A 11/1994
(Continued)

OTHER PUBLICATIONS

International Search Report dated Aug. 28, 2018 in PCT/JP2018/026398 filed on Jul. 12, 2018, 2 pages.

*Primary Examiner* — Lincoln D Donovan
*Assistant Examiner* — Alex W Lam
(74) *Attorney, Agent, or Firm* — Oblon, McClelland, Maier & Neustadt, L.L.P.

(57) ABSTRACT

Provided are a coil unit for electromagnetic forming capable of stably processing a plurality of portions in the longitudinal direction of a tubular member while preventing the contact between the tubular member and a conductor or the contact between the conductors even when the tubular member is long, and a method for producing a formed article using the coil unit. The coil unit for electromagnetic forming includes: a shaft core member made of a resin; a conductor having a wound portion, which is wound around the shaft core member, and a pair of conductor extension portions; an insulating support; and a resin coating layer formed on the outer peripheral surface of the wound portion. In the insu-
(Continued)

lating support, a conductor holding portion for holding the conductor extension portions apart from each other is formed along the longitudinal direction.

11 Claims, 32 Drawing Sheets

(51) Int. Cl.
*H01F 7/08* (2006.01)
*B21D 26/14* (2006.01)

(56) References Cited

U.S. PATENT DOCUMENTS

| | | | | |
|---|---|---|---|---|
| 2009/0251257 | A1* | 10/2009 | Stelzer | H01F 7/20 29/602.1 |
| 2010/0134227 | A1* | 6/2010 | Mori | B21D 26/14 336/83 |
| 2011/0043196 | A1* | 2/2011 | Fujita | G01D 5/2046 324/207.16 |

FOREIGN PATENT DOCUMENTS

| | | | |
|---|---|---|---|
| JP | 10-31 4869 | A | 12/1998 |
| JP | 10-314869 | A | 12/1998 |
| JP | 2004-237348 | A | 8/2004 |
| JP | 4001557 | B2 | 8/2007 |
| JP | 4001557 | B2 | 10/2007 |
| JP | 2013-42029 | A | 2/2013 |
| WO | WO 201 4/030719 | A1 | 2/2014 |

* cited by examiner

ELECTROMAGNETIC FORMING COIL UNIT AND FORMED-ARTICLE PRODUCING METHOD USING SAME

TECHNICAL FIELD

The present invention relates to an electromagnetic forming coil unit and a formed-article producing method using the electromagnetic forming coil unit.

BACKGROUND ART

Steel members are used as automotive structural parts in many cases from the viewpoint of cost and workability in welding, etc. In response to recent demands for improvement of fuel economy, replacing some of the automotive structural parts made of the steel members with lightweight members has been tried, and applying those lightweight members to not only panel members, but also frame members has been considered.

An aluminum alloy is preferably used as the lightweight member. When a bracket or the like is attached to the lightweight member, using fixation by crimping to join the lightweight member to a counterpart member, such as a bracket, has been considered from the viewpoint of avoiding thermal deformation during welding of the bracket. A method utilizing electromagnetic forming is proposed as the fixing method by crimping (Patent Literature (PTL) 1). A method of partly forming a comparatively long tubular member with application of the electromagnetic forming is also proposed (PTL 2).

CITATION LIST

Patent Literature

PTL 1: Japanese Unexamined Patent Application Publication No. 2004-237348

PTL 2: Japanese Unexamined Patent Application Publication No. 6-312226

SUMMARY OF INVENTION

Technical Problem

According to the fixation by crimping, because no thermal strain generates, a structure can be obtained with higher accuracy than when a working method using welding is employed. A frame member, a reinforce, or a similar component has features that an entire length is longer than a diameter and the diameter changes along an axial direction. In PTLs 1 and 2, tube expansion forming is performed on part of an aluminum tube along its entire length or near an end portion thereof. However, a member having a shape changing in the axial direction needs crimping to be performed at plural positions in the axial direction, and application of an electromagnetic forming coil disclosed in PTL 1 to such a member is difficult.

On the other hand, an electromagnetic forming coil disclosed in PTL 2 can perform electromagnetic tube expansion at plural positions by moving a coil portion to a predetermined place. However, PTL 2 takes no consideration about arrangements of conductors extending from an end of the coil portion.

In the electromagnetic forming, a tubular member, i.e., a forming target, is placed near a coil portion (inductor), and energy charged in a capacitor is applied to the coil portion as a pulse-like large current for a very short time within several milliseconds (ms). The pulse-like large current flows through not only a conductor wound portion in the coil portion, but also a pair of conductors extending from the end of the coil portion. Accordingly, during energization for the electromagnetic forming, because conductor extension portions are caused to displace due to electromagnetic forces generated by them, the conductor may contact, the tubular member, or the conductors may contact each other. Consequently, stable production cannot be achieved for the reason that the tubular member or the coil portion may be damaged (due to the occurrence of a short circuit or a spark) and a power supply device may be damaged in some cases.

The present invention is intended to solve the above-described problem and is to provide an electromagnetic forming coil unit capable of stably processing a tubular member at plural positions in a longitudinal direction while preventing contact between a tubular member and a conductor or contact between conductors during energization even when the tubular member is long, and to further provide a formed-article producing method using the electromagnetic forming coil unit.

Solution to Problem

The present invention is constituted as follows.

(1) An electromagnetic forming coil unit configured to extend in a longitudinal direction from a base end toward a fore end, inserted into a tubular member with the fore end being ahead, and used to expand the tubular member by electromagnetic force, the electromagnetic forming coil unit including:

a shaft core member made of a resin;

a conductor including a wound portion wound over a periphery of the shaft core member, and a pair of conductor extension portions extending from the wound portion toward the base end;

an insulating support disposed on at least one end of the shaft core member in the axial direction and extending in the longitudinal direction; and a resin covering layer covering an outer peripheral surface of the wound portion of the conductor, wherein conductor holding portions holding the pair of conductor extension portions apart from each other are formed in the insulating support along the longitudinal direction.

According to the above electromagnetic forming coil unit, even when the tubular member is long, stable processing can be performed on the tubular member at plural positions in the longitudinal direction without causing contact between the tubular member and the conductor or contact between the conductors during energization.

(2) An electromagnetic forming coil unit configured to extend in a longitudinal direction from a base end toward a fore end, inserted into a tubular member with the fore end being ahead, and used to expand the tubular member by electromagnetic force, wherein the electromagnetic forming coil unit, includes a plurality of coil portions separately disposed along the longitudinal direction, each of the coil portions including:

a shaft core member made of a resin;

a conductor including a wound portion wound over a periphery of the shaft core member, and a pair of conductor extension portions extending from the wound portion toward the base end; and a resin covering layer covering an outer peripheral surface of the wound portion of the conductor, wherein insulating supports are disposed along the longitudinal direction between adjacent two of the coil portions and between the base end and a base-end-side end of the shaft core member in the coil portion disposed closest to the base end side, and wherein conductor holding portions holding the pair of conductor extension portions apart from each other are formed in each of the insulating supports along the longitudinal direction.

According to the above electromagnetic forming coil unit, even when the tubular member is long, the tubular member can be expanded at plural positions in the longitudinal direction at once without causing contact between the tubular member and the conductor or contact between the conductors during energization.

(3) In the electromagnetic forming coil unit stated in (1) or (2), the conductor is a tubular conductor.

According to the above electromagnetic forming coil unit, a coil heated with energization can be cooled by flowing a coolant through the tubular conductor.

(4) In the electromagnetic forming coil unit stated in (3), a terminal is connected to a base-end-side end of the conductor extension portion.

According to the above electromagnetic forming coil unit, since the terminal can easily be connected to and disconnected from a terminal on the connection counterpart side, convenience in handling of the electromagnetic forming coil unit is improved. It is hence easily possible to mount the electromagnetic forming coil unit to another processing stage, or to mount a new electromagnetic forming coil unit.

(5) In the electromagnetic forming coil unit stated in (4), the terminal is a plate-shaped terminal.

According to the above electromagnetic forming coil unit, since the terminal is a plate-shaped terminal, the terminal can be connected in surface contact to the terminal on the connection counterpart side, and a short circuit, a spark, etc. are less apt to occur.

(6) In the electromagnetic forming coil unit stated in (5), the conductor extension portion is formed to extend from the insulating support toward the base end, and the terminal is formed to extend in the longitudinal direction.

According to the above electromagnetic forming coil unit, since the terminal is formed to extend in the longitudinal direction of the electromagnetic forming coil unit, a contactable range with the terminal on the connection counterpart side can be enlarged. Therefore, when the electromagnetic forming coil unit is moved, the terminals can be contacted with each other without moving the terminal on the connection counterpart side corresponding to the movement of the electromagnetic forming coil unit.

(7) In the electromagnetic forming coil unit stated in (5), the conductor extension portion is formed to extend from the insulating support toward the base end, and the terminal is disposed at each of plural positions along the longitudinal direction.

According to the above electromagnetic forming coil unit, since the terminal is disposed at each of plural positions along the longitudinal direction of the electromagnetic forming coil unit, the terminal on the connection counterpart side can be optionally contacted with the former terminal at each of the plural positions by moving the electromagnetic forming coil unit. As a result, electromagnetic forming can easily be performed at different forming positions by arranging the terminal on the connection counterpart side at a predetermined position in the longitudinal direction of the electromagnetic forming coil unit, and by moving the electromagnetic forming coil unit such that the terminal at each of the plural positions successively contacts the terminal on the connection counterpart side.

(8) A formed-article producing method using the electromagnetic forming coil unit stated in (1), the method successively executing:

a tubular member placement step of placing the tubular member at a processing position;

a coil placement step of inserting the electromagnetic forming coil unit into the tubular member and placing the wound portion of the conductor at a tube expansion position of the tubular member; and a tube expansion step of expanding the tubular member at the tube expansion position by electromagnetic force generated by supplying a current to the conductor in the electromagnetic forming coil unit.

According to the above formed-article producing method, the tubular member can be expanded by the electromagnetic forming coil unit at the desired tube expansion position.

(9) A formed-article producing method using the electromagnetic forming coil unit stated in (2), the method successively executing:

a tubular member placement step of placing the tubular member at a processing position;

a coil placement step of inserting the electromagnetic forming coil unit into the tubular member and placing the wound portions of the conductors at different tube expansion positions of the tubular member; and a tube expansion step of expanding the tubular member at the tube expansion positions by electromagnetic force generated by supplying currents to the conductors in the electromagnetic forming coil unit.

According to the above formed-article producing method, the tubular member can be expanded at the plural tube expansion positions at once, and a tact time can be shortened.

(10) In the formed-article producing method stated in (8) or (9), the tubular member placement step includes a step of placing a rigid member around the tubular member at the tube expansion position, the rigid member surrounding the tubular member in a circumferential direction.

According to the above formed-article producing method, the tubular member can be fixed to the rigid member by crimping.

(11) In the formed-article producing method stated in (8) or (9), after the tube expansion step, the electromagnetic forming coil unit is moved in the longitudinal direction to place the wound portion of the conductor at a next tube expansion position different from the previous tube expansion position, and the tube expansion step is executed again.

According to the above formed-article producing method, since the tubular member can be expanded at plural positions by using the same electromagnetic forming coil unit, an increase in the number of electromagnetic forming coil portions can be avoided even with an increase in the number of tube expansion position.

(12) In the formed-article producing method stated in (10), the tubular member placement step includes a step of placing a rigid member around the tubular member at the tube expansion position, the rigid member surrounding the tubular member in a circumferential direction.

According to the above formed-article producing method, the tubular member is radially bulged outward over an entire circumference and strikes against the rigid member in the process of tube expansion, whereby the tubular member is uniformly crimped along the circumferential direction.

(13) In the formed-article producing method stated in (11) or (12), wherein, in the coil placement step, the electromagnetic forming coil unit is inserted into the tubular member from each of both axial ends thereof.

According to the above formed-article producing method, since the electromagnetic forming coil portion of the electromagnetic forming unit is inserted into the tubular member from each of both axial ends thereof, the tube expansion step can be simplified in comparison with the case of inserting the electromagnetic forming coil portion into the tubular member from one axial end of the tubular member. Moreover, an entire length of the electromagnetic forming coil portion can be shortened, and positioning accuracy can be increased.

Advantageous Effects of Invention

According to the present invention, even when the tubular member is long, stable processing can be performed on the tubular member at plural positions in the longitudinal direction while contact between the tubular member and the conductor or contact between the conductors during the energization are prevented. Hence the tubular member expanded by the electromagnetic forming can be obtained without causing damages.

DESCRIPTION OF EMBODIMENTS

Embodiments of the present invention will be described in detail below with reference to the drawings.

<Structure of Formed Article>

Figure 1:
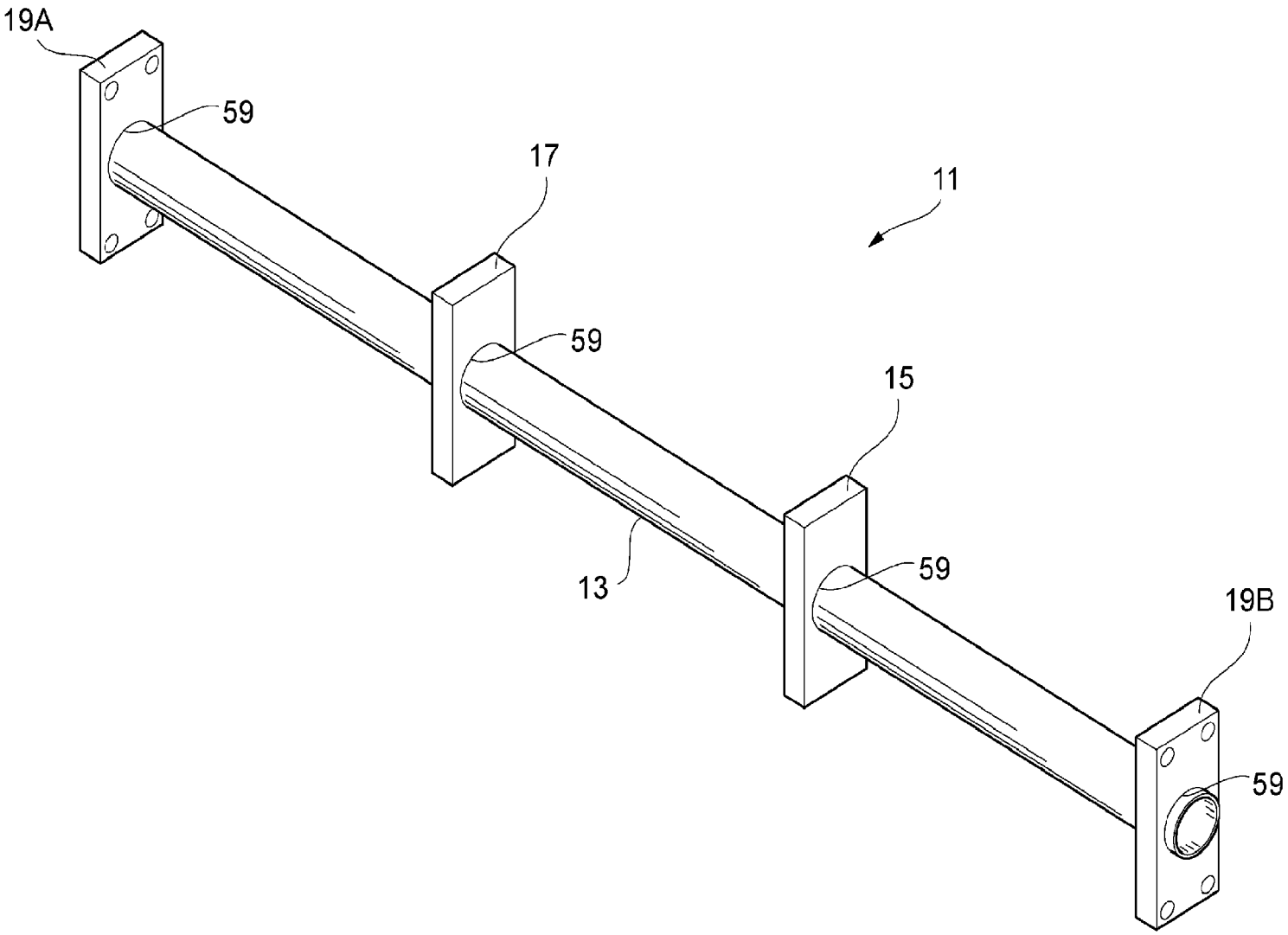
FIG. 1 is a schematic external perspective view of a formed article produced by electromagnetic forming.

FIG. 1 is a schematic external perspective view of a formed article produced by electromagnetic forming.

The formed article 11 includes an aluminum tube member 13, brackets 15 and 17 disposed around an outer periphery of the aluminum tube member 13, and brackets 19A and 19B disposed at both ends of the aluminum tube member 13. Through-holes 59 are formed in the brackets 15, 17, 19A and 19B. The aluminum tube member 13 is fixedly held in a state inserted through the through-holes 59.

The aluminum tube member 13 is not limited to a circular tube, and it may be a rectangular tube having a square or rectangular cross-section, a hexagonal tube having a hexagonal cross-section, or an octagonal tube having an octagonal cross-section. The aluminum tube member 13 can be produced by extrusion molding or welding of a plate material. A preferable material of the aluminum tube member 13 is, for example, an aluminum alloy (such as JIS 6000 or 7000 series).

The brackets 15, 17, 19A and 19B (hereinafter also collectively called the "bracket(s)") are each a rigid member constituted integrally with the aluminum tube member 13. A preferable material of the bracket is, for example, steel, an aluminum extruded material, an aluminum cast, or a resin injected material.

<First Structure Example of Electromagnetic Forming Apparatus>

A structure of an electromagnetic forming apparatus for producing the formed article 11 by electromagnetic forming, which includes the brackets fixed to the outer periphery of the aluminum tube member 13 by crimping, will be described below.

Figure 2:
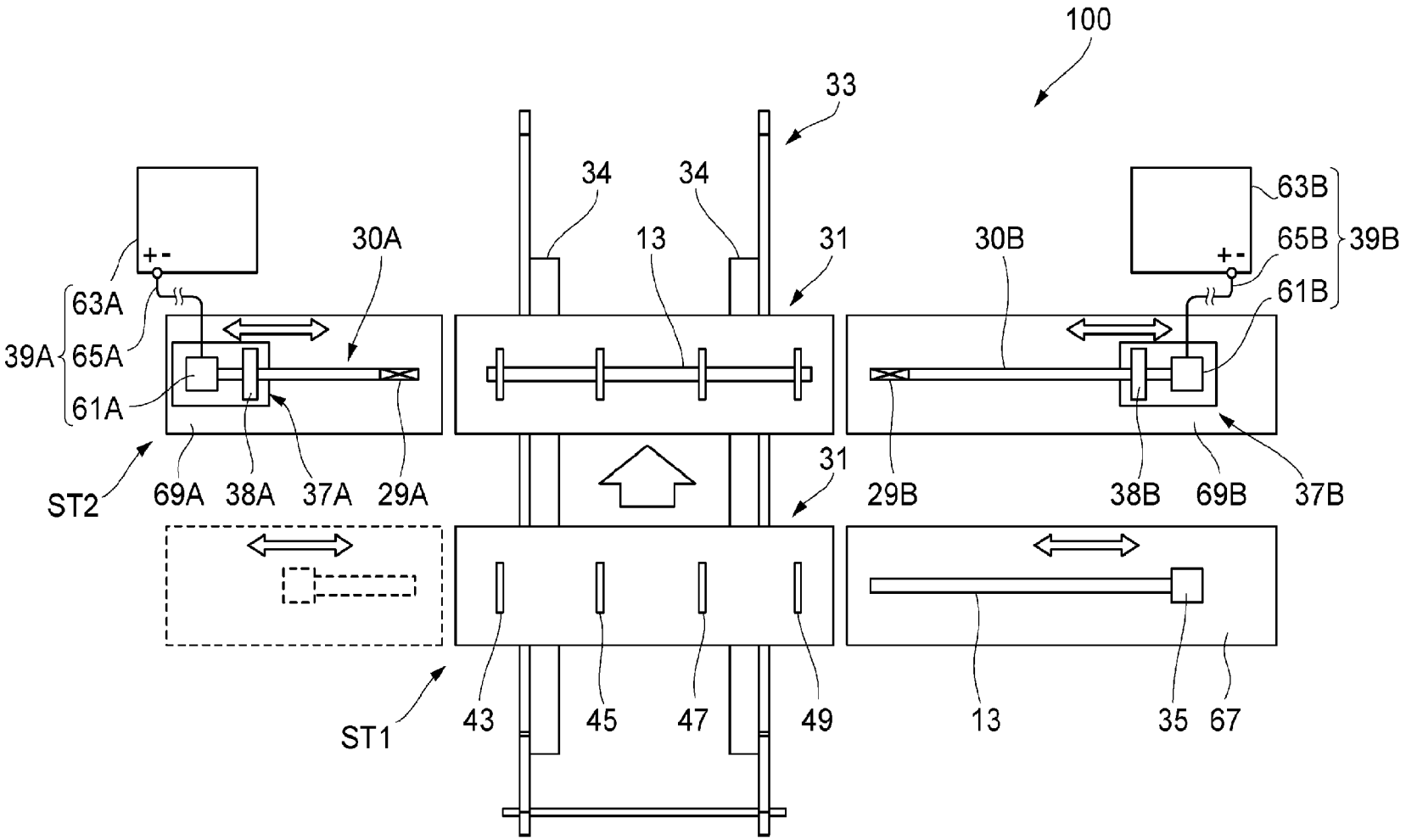
FIG. 2 is a schematic plan view of an electromagnetic forming apparatus according to a first structure example.

FIG. 2 is a schematic plan view of the electromagnetic forming apparatus 100 according to a first structure example.

The electromagnetic forming apparatus 100 includes a plurality of jig plates 31, a jig plate transport mechanism 33, a tube insertion mechanism 35, a first coil unit 30A, a second coil unit 30B, a first coil moving mechanism 37A, a second coil moving mechanism 37B, and current supply units 39A and 39B.

The electromagnetic forming apparatus 100 includes a tube insertion stage ST1 and a tube expansion stage ST2. In the tube insertion stage ST1, the aluminum tube member 13 is transferred onto the jig plate 31 by the tube insertion mechanism 35. The jig plate transport mechanism 33 transports, from the tube insertion stage ST1 to the tube expansion stage ST2, the jig plate 31 into which the aluminum tube member 13 has been inserted. In the tube expansion stage ST2, the first coil unit 30A is inserted, by the first coil moving mechanism 37A, into the aluminum tube member 13 supported by the jig plate 31. Furthermore, the second coil unit 30B is inserted, by the second coil moving mechanism 37B, into the aluminum tube member 13 supported by the jig plate 31. Then, a first electromagnetic forming coil portion 29A of the first coil unit 30A is energized by the current supply unit 39A, and a second electromagnetic forming coil portion 29B of the second coil unit 30B is energized by the current supply unit 39B. As a result, the aluminum tube member 13 is expanded by the electromagnetic forming.

<Jig Plate>

Figure 3:
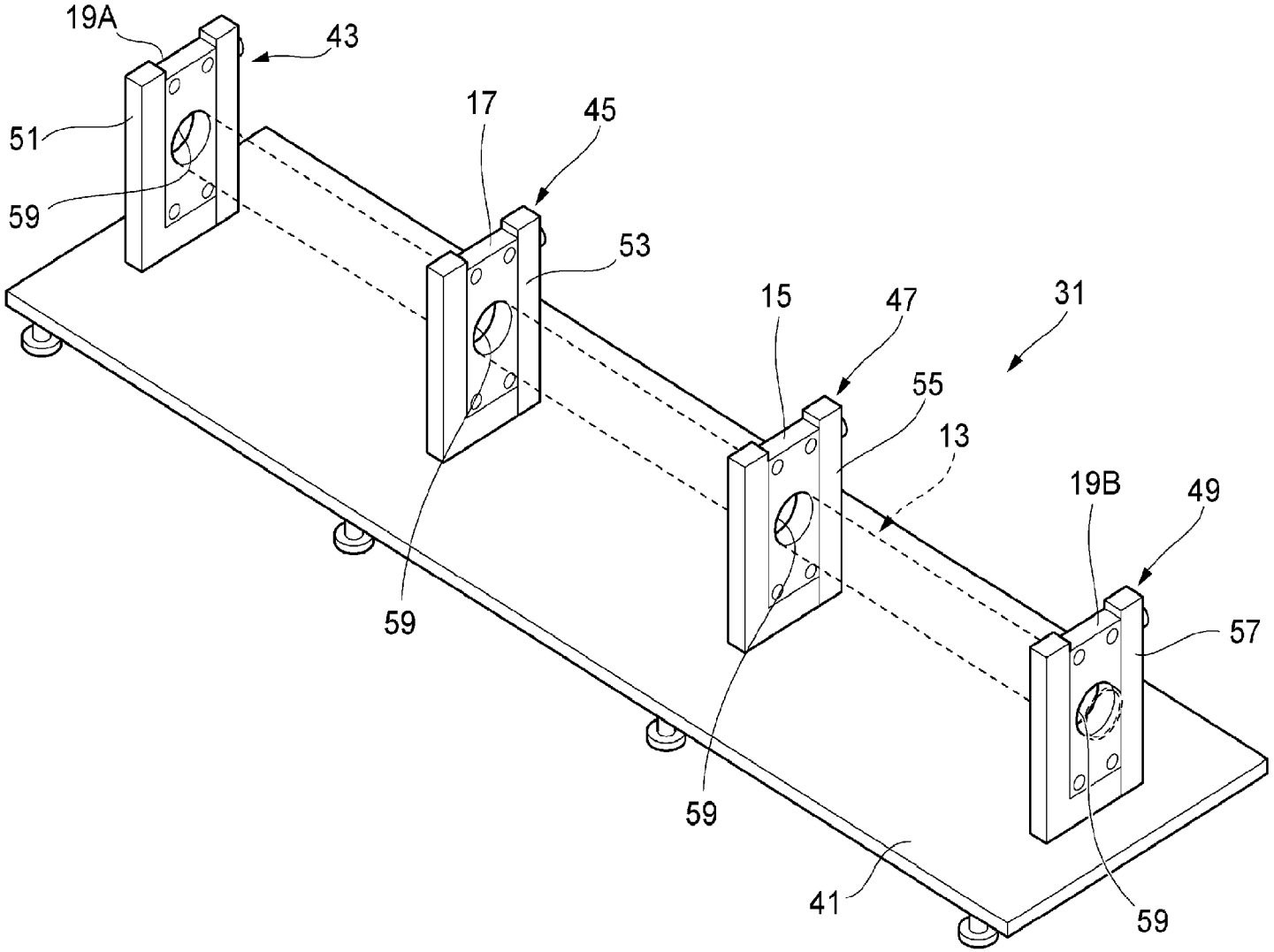
FIG. 3 is a perspective view of a jig plate.

FIG. 3 is a perspective view of the jig plate 31. FIG. 3 further illustrates the aluminum tube member 13 and the brackets 15, 17, 19A and 19B to be fixed to the aluminum tube member 13. The aluminum tube member 13 in FIG. 3 is denoted by dotted lines.

The jig plate 31 includes a base plate 41 and bracket holders 51, 53, 55 and 57 fixed onto the base plate 41.

The base plate 41 is formed of a single plate of steel material. An aluminum alloy or a resin material may also be used instead of the steel material. As the resin material, a fiber reinforced plastic, such as a carbon fiber reinforced plastic (CFRP), may be used.

The bracket holder 51 holds the bracket 19A and constitutes a support member 43 together with the bracket 19A. Similarly, the bracket holder 53 holds the bracket 17 and constitutes a support member 45. The bracket holder 55 holds the bracket 15 and constitutes a support member 47. The bracket holder 57 holds the bracket 19B and constitutes a support member 49. The bracket holders 51, 53, 55 and 57 fixedly hold the brackets by clamping them from the outer side in a radial direction with not-illustrated toggle clamps, for example.

The through-holes 59 through which the aluminum tube member 13 is to be inserted are coaxially formed in the brackets 15, 17, 19A and 19B that are fixed respectively to the bracket holders 51, 53, 55 and 57. In other words, all the through-holes 59 are coaxially formed in the support members 43, 45, 47 and 49 vertically disposed on the jig plate 31, and each of the through-holes 59 guides the aluminum tube member 13 when the aluminum tube member 13 is inserted.

In order to hold an elongate member having a longer axial length than a diameter, like the aluminum tube member 13 in this structure example, in a state with minimum bend, the jig plate 31 is required to have high rigidity in itself. Therefore, a steel plate having high rigidity is preferably used as the base plate 41 of the jig plate 31.

There is a possibility that an induction current generated in the aluminum tube member 13 with energization of the electromagnetic forming coil portions (i.e., the first electromagnetic forming coil portion 29A and the second electromagnetic forming coil portion 29B in FIG. 2) may be conducted to the base plate 41 of the jig plate 31 through the support members 43, 45, 47 and 49. In consideration of the above point, an insulating layer having electrical insulation properties is preferably coated on the base plate 41 of the jig plate 31. For example, a phenol resin (such as Bakelite (registered trademark)) can be used for the insulating layer.

With the provision of the insulating layer on the base plate 41, a leak of the induction current necessary for the electromagnetic forming can be prevented, and a satisfactory degree of the electromagnetic forming of the aluminum tube member 13 can be ensured. The insulating layer is preferably coated over an entire lower surface of the base plate 41 of the jig plate 31 from the viewpoint, of more reliably blocking the conduction of the induction current. In addition, positional deviations of the support members 43, 45, 47 and 49 attributable to a thickness distribution of the insulating layer are reduced in comparison with the case of coating the insulating layer over an upper surface of the base plate 41. Thus, the aluminum tube member 13 can be supported in a high-accurately positioned state.

<Tube Insertion Mechanism>

A base 67 is disposed on the one end side of the jig plate 31 in the tube insertion stage ST1 illustrated in FIG. 2. The tube insertion mechanism 35 is disposed on the base 67. The tube insertion mechanism 35 axially moves the aluminum tube member 13 toward the jig plate 31. Thus, the tube insertion mechanism 35 inserts the aluminum tube member 13 through the through-holes 59 of the support members 43, 45, 47 and 49.

The base plate 41 of the jig plate 31 placed on the jig plate transport mechanism 33 and the base 67 are arranged such that their upper surfaces are parallel to each other. In a tube insertion operation, therefore, the aluminum tube member 13 is inserted through the through-holes 59 (see FIG. 1) of the support members 43, 45, 47 and 49 on the jig plate 31 while it is kept in a high-accurately coaxial state with the through-holes. Because the through-holes 59 function as guide holes for guiding the aluminum tube member 13, the aluminum tube member 13 can be smoothly inserted, and the occurrence of misalignment can be prevented.

<Coil Units>

The first coil unit 30A and the second coil unit 30B are disposed on both the sides of the jig plate 31 in the tube expansion stage ST2. The first electromagnetic forming coil portion 29A is disposed in a fore end portion of the first coil unit 30A, and the second electromagnetic forming coil portion 29B is disposed in a fore end portion of the second coil unit 30B.

Figure 4:
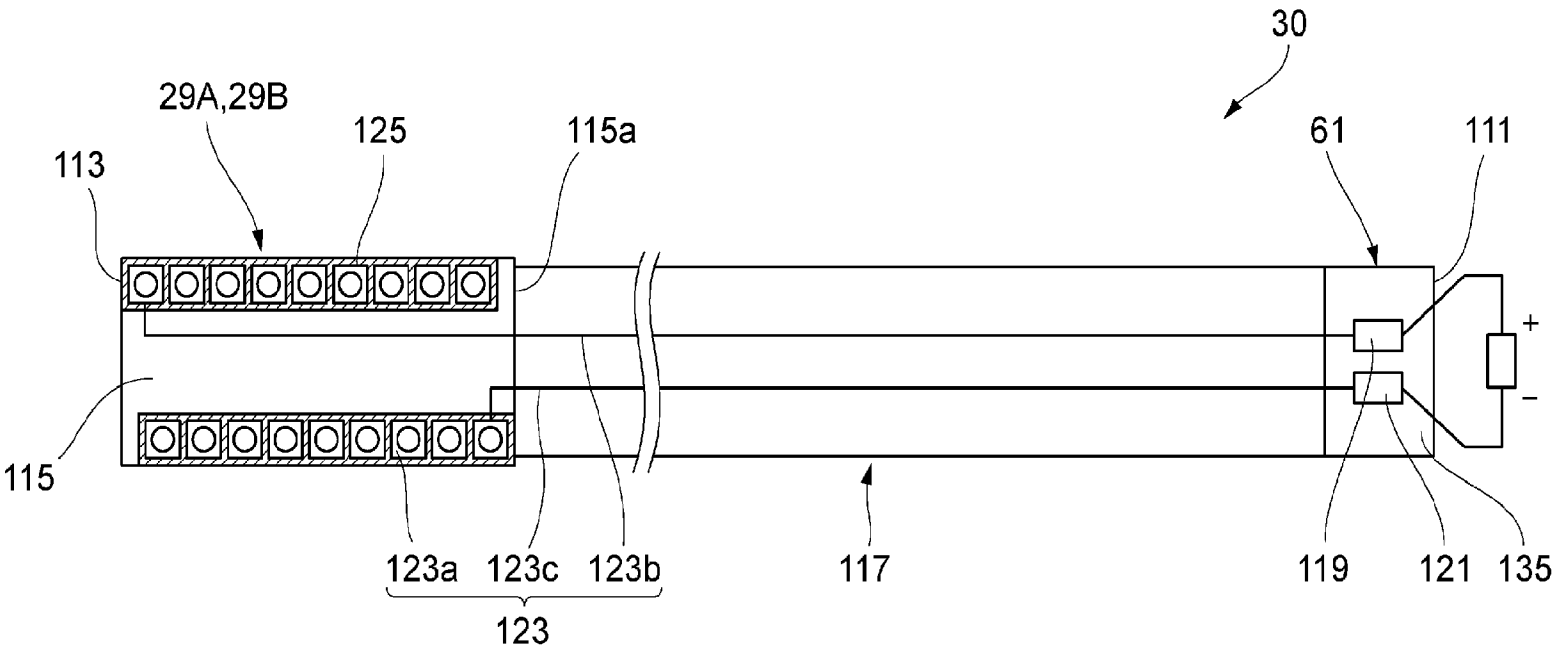
FIG. 4 is a schematic structural view of an electromagnetic forming coil unit according to the first structure example.

FIG. 4 is a schematic structural view of the electromagnetic forming coil unit according to the first structure example. Because the first coil unit 30A and the second coil unit 30B have a similar structure except for a total length in a longitudinal direction, they are called an electromagnetic forming coil unit 30 in the following description with reference to FIGS. 4 to 10. The electromagnetic forming coil unit 30 is disposed to extend along the longitudinal direction toward a fore end 113 from a base end 111, and is inserted into a tubular member (i.e., the aluminum tube member 13 in FIG. 2) with the fore end 113 positioned ahead. The tubular member is then expanded.

The electromagnetic forming coil unit 30 includes a resin-made shaft core member 115 having a circular columnar shape, an insulating support 117 having electrical insulation properties and disposed to extend along the longitudinal direction from one end 115*a* of the shaft core member 115 on the side closer to the base end 111, a conductor 123 forming the coil portion together with the shaft core member 115, and a coil-side terminal support portion 135 disposed on the side close to the base end 111 and including coil-side terminals (terminals) 119 and 121 that are provided therein and connected to the conductor 123.

The conductor 123 includes a wound portion 123*a* wound around a periphery of the shaft core member 115, and a pair of conductor extension portions 123*b* and 123*c* extending from the wound portion 123*a* toward the base end 111. In more detail, the conductor extension portion 123*b* is arranged to extend from a start end (on the side close to the fore end 113) of the wound portion 123*a* to the inside of the shaft core member 115, and the conductor extension portion 123*c* is arranged to extend from a terminal end (i.e., the one end 115*a* of the shaft core member 115 closer to the base end 111) of the wound portion 123*a*.

A resin covering layer 125 covering the conductor 123 and having electrical insulation properties is disposed over an outer peripheral surface of the wound portion 123*a* of the conductor 123. The resin covering layer 125 is formed by winding a glass fiber tape over a surface of the conductor 123, further winding the conductor 123 covered with the tape over an outer periphery of the shaft core member 115, and impregnating the tape of the wound conductor 123 with a resin. Thus, the resin covering layer 125 is disposed not only over the outer periphery of the wound portion 123*a*, but also between the adjacent conductors 123 in the wound portion 123*a* and over an inner periphery of the wound portion 123*a*. Regarding details of the resin covering layer 125, refer to Japanese Unexamined Patent Application Publication No. 2004-40044.

The first electromagnetic forming coil portion 29A (also the second electromagnetic forming coil portion 29B) is constituted by the shaft core member 115, the wound portion 123*a* of the conductor 123 disposed over the shaft core member 115, and the resin covering layer 125. In other words, the first electromagnetic forming coil portion 29A is a region of the electromagnetic forming coil unit 30 in the longitudinal direction, the region corresponding to the wound portion 123*a* of the conductor 123. This is similarly applied to another coil portion, for example, the second electromagnetic forming coil portion 29B.

Figure 5:
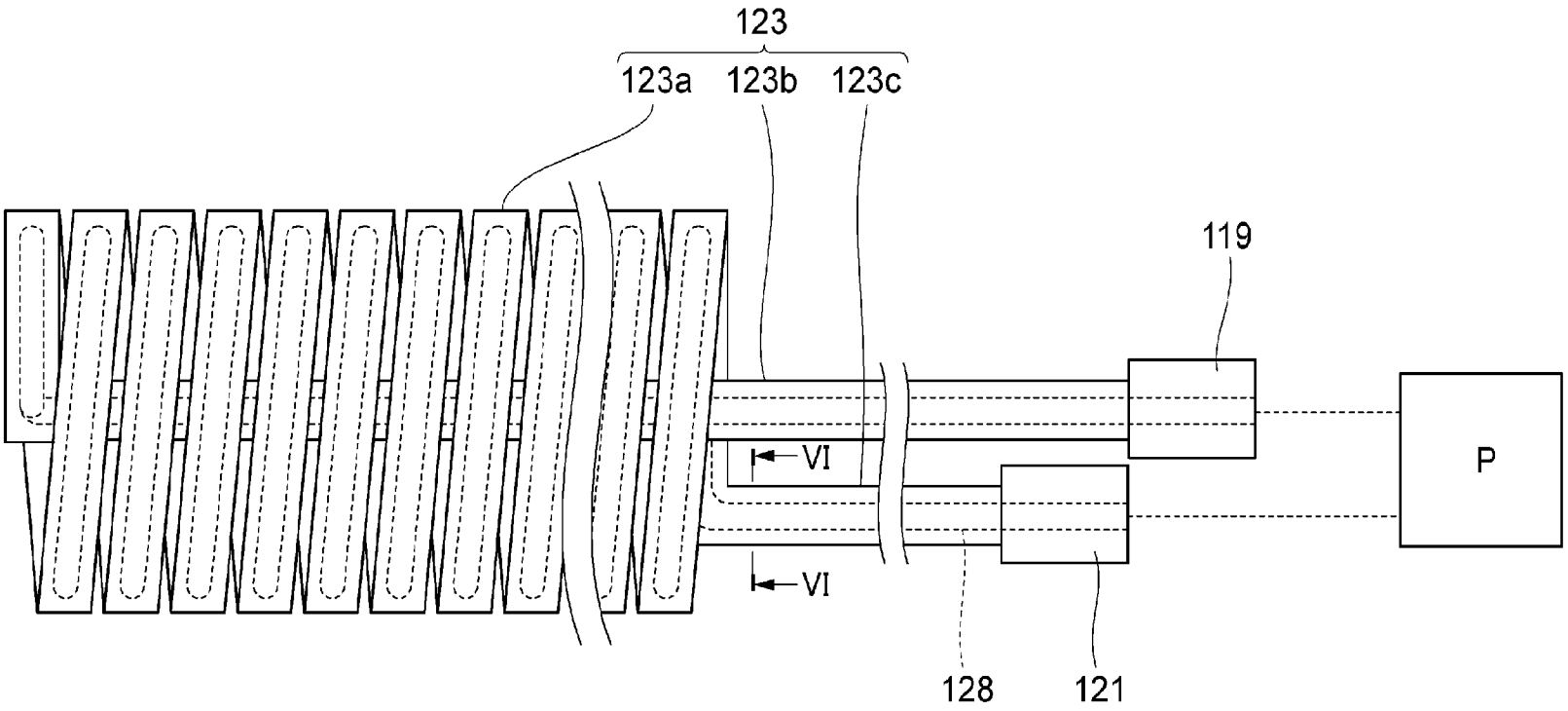
FIG. 5 is a schematic structural view illustrating the structure of a conductor alone.
Figure 6:
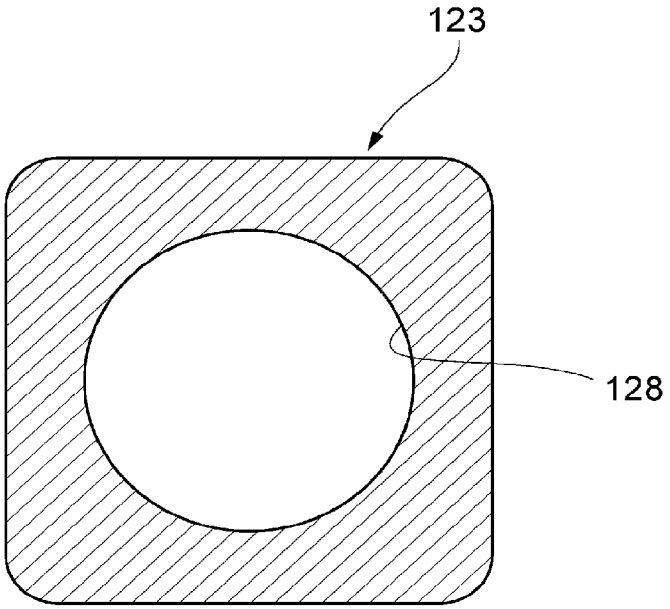
FIG. 6 is a sectional view, taken along line VI-VI, of the conductor illustrated in FIG. 5.

FIG. 5 is a schematic structural view illustrating the structure of the conductor 123 alone, and FIG. 6 is a sectional view, taken along line VI-VI, of the conductor 123 illustrated in FIG. 5.

The conductor 123 is a tubular conductive line (hollow conductor) having a substantially square shape in a cross-section perpendicular to a conductor axis and including a communication hole 128 formed at a center. The communication hole 128 is formed over an entire length of the conductor 123. The above-mentioned coil-side terminals 119 and 121 are connected to ends of the conductor extension portions 123*b* and 123*c*, respectively. A pump P for supplying a coolant is connected to the communication holes 128 of the conductor extension portions 123*b* and 123*c* through the coil-side terminals 119 and 121. For example, air, nitrogen gas, argon gas, or helium gas is used as the coolant. The wound portion 123*a*, the conductor extension portions 123*b* and 123*c*, etc., each generating heat during energization, are cooled by supplying the coolant to the communication hole 128.

Figure 7:
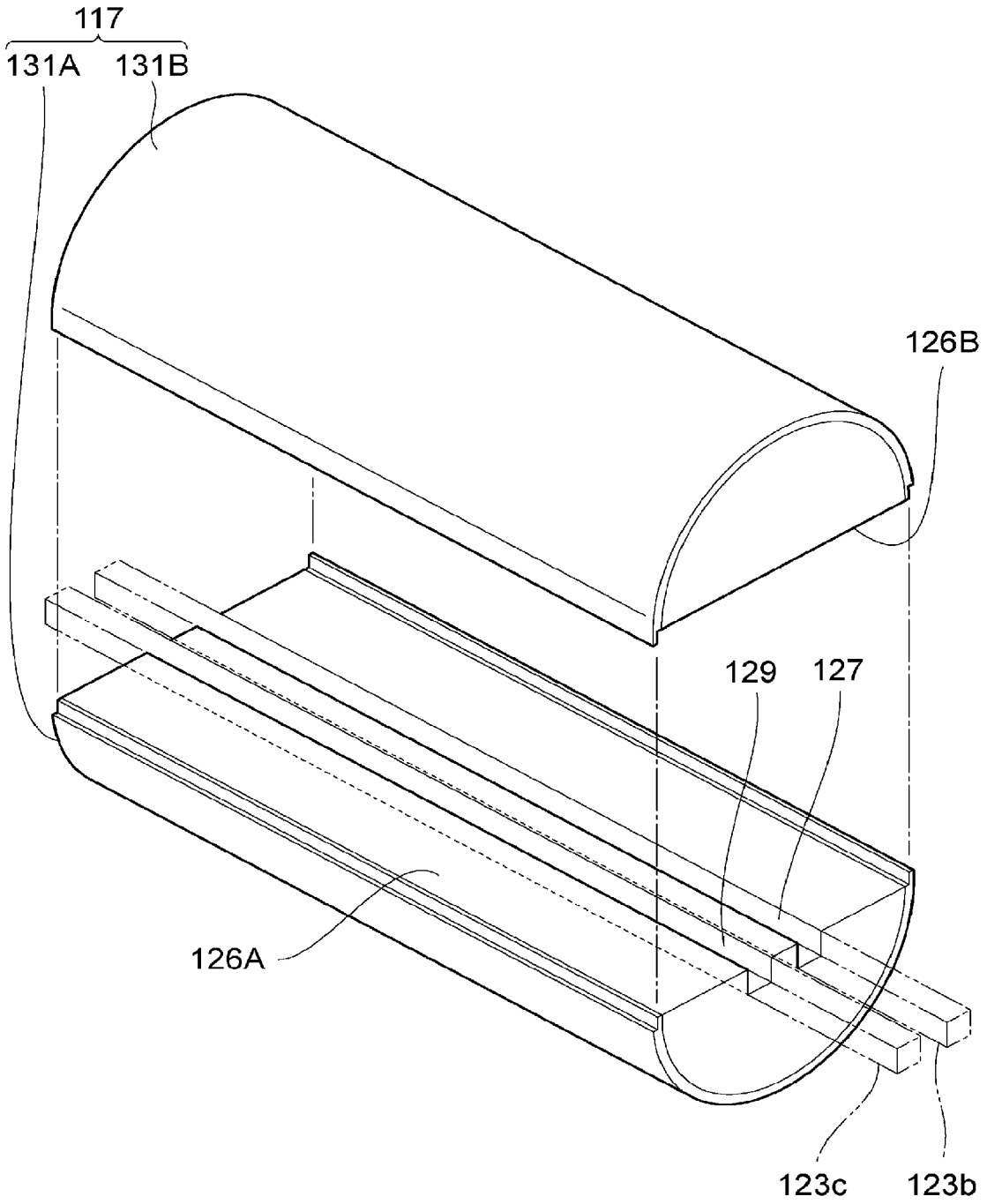
FIG. 7 is a partly-exploded perspective view of an insulating support.

FIG. 7 is a partly-exploded perspective view of the insulating support 117.

The insulating support 117 occupies a region from the shaft core member 115 to the base end 111 illustrated in FIG. 4, specifically to a terminal connection portion 61 in which the coil-side terminals 119 and 121 are disposed. The insulating support 117 may be formed integrally with the shaft core member 115, or may be formed as a member separate from the shaft core member 115 such that it can be divided from the shaft core member 115. The insulating support 117 in the illustrated example is a circular columnar member formed separately from the shaft core member 115, and is constituted by a pair of split pieces 131A and 131B each having a semicircular shape in cross-section perpendicular to the axial direction.

A pair of grooves (conductor holding portions) 127 and 129 for holding (fixing) the pair of the conductor extension portions 123*b* and 123*c* in a state apart from each other through a certain distance are formed in a split opposing surface 126A of one split piece 131A to extend in the longitudinal direction of the insulating support 117. A split opposing surface 126B of the other split piece 131B, which is opposed to the grooves 127 and 129, may be a flat surface or may include a pair of similar grooves formed at positions opposing to the grooves 127 and 129.

Figure 8:
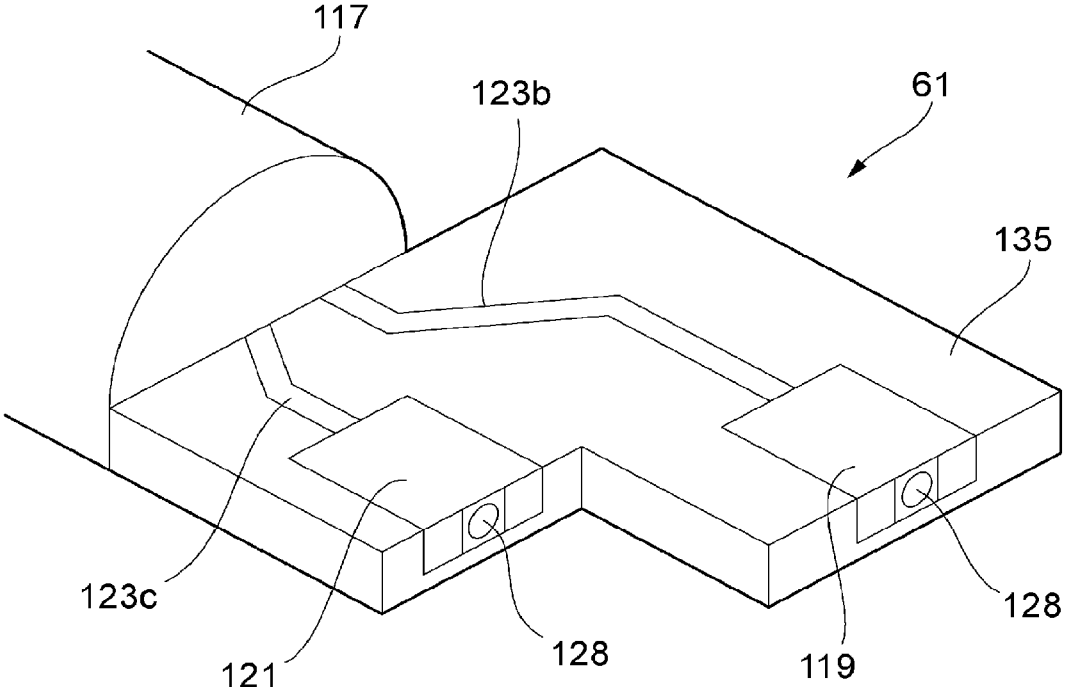
FIG. 8 is a perspective view of a coil-side terminal support portion disposed on the base end side of the insulating support.

FIG. 8 is a perspective view of the coil-side terminal support portion 135 disposed on one side of the insulating support 117 closer to the base end 111 (see FIG. 4).

The coil-side terminal support portion 135 in the form of a flat plate is disposed on the base end 111-side of the insulating support 117. The coil-side terminal support portion 135 may be constituted integrally with the insulating support 117, or may be a piece of plate separately attached to the insulating support 117.

The coil-side terminal support portion 135 in this structure example has a stepped structure having different projection lengths in the longitudinal direction of the insulating support 117. The coil-side terminal 119 is disposed in a portion of the stepped structure on the side having the longer projection length, and the coil-side terminal 121 is disposed in a portion of the stepped structure on the side having the shorter projection length. The coil-side terminals 119 and 121 are each formed of a plate-shaped metal piece and are fixedly held on the coil-side terminal support portion 135 apart from each other.

Figure 9:
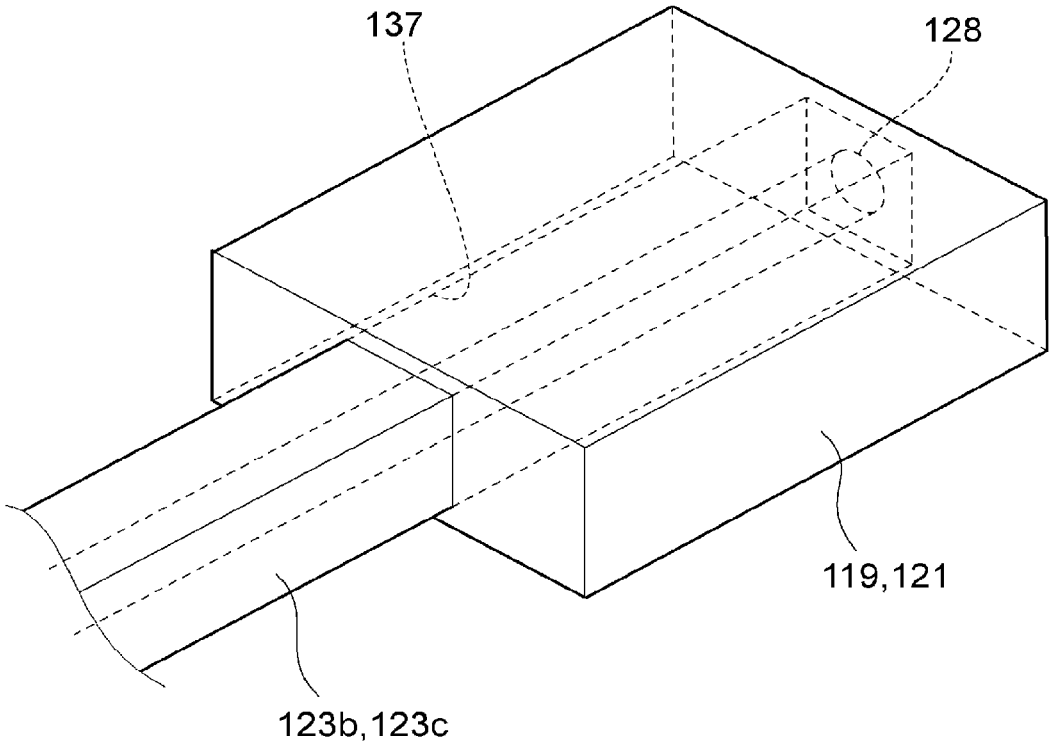
FIG. 9 is an enlarged perspective view of a coil-side terminal.

FIG. 9 is an enlarged perspective view of the coil-side terminal 119, 121.

A conductor fixation hole 137 is formed in the coil-side terminal 119, 121 to penetrate therethrough. An end of the conductor extension portion 123*b* is inserted to the conductor fixation hole 137 of the coil-side terminal 119. An end of the conductor extension portion 123*c* is inserted to the conductor fixation hole 137 of the coil-side terminal 121. The conductor extension portions 123*b* and 123*c* are fixed respectively to the coil-side terminals 119 and 121 by brazing, for example.

Thus, in the conductor 123 in this structure example, the conductor extension portions 123*b* and 123*c* are disposed in a region of the electromagnetic forming coil unit 30 illustrated in FIG. 4, the region spanning to the base end 111 from the coil portions (i.e., the first electromagnetic forming coil portion 29A and the second electromagnetic forming coil portion 29B) on the side close to the fore end 113, and the coil-side terminals 119 and 121 are connected to the ends of the conductor extension portions 123*b* and 123*c* on the side close to the base end 111.

Figure 10:
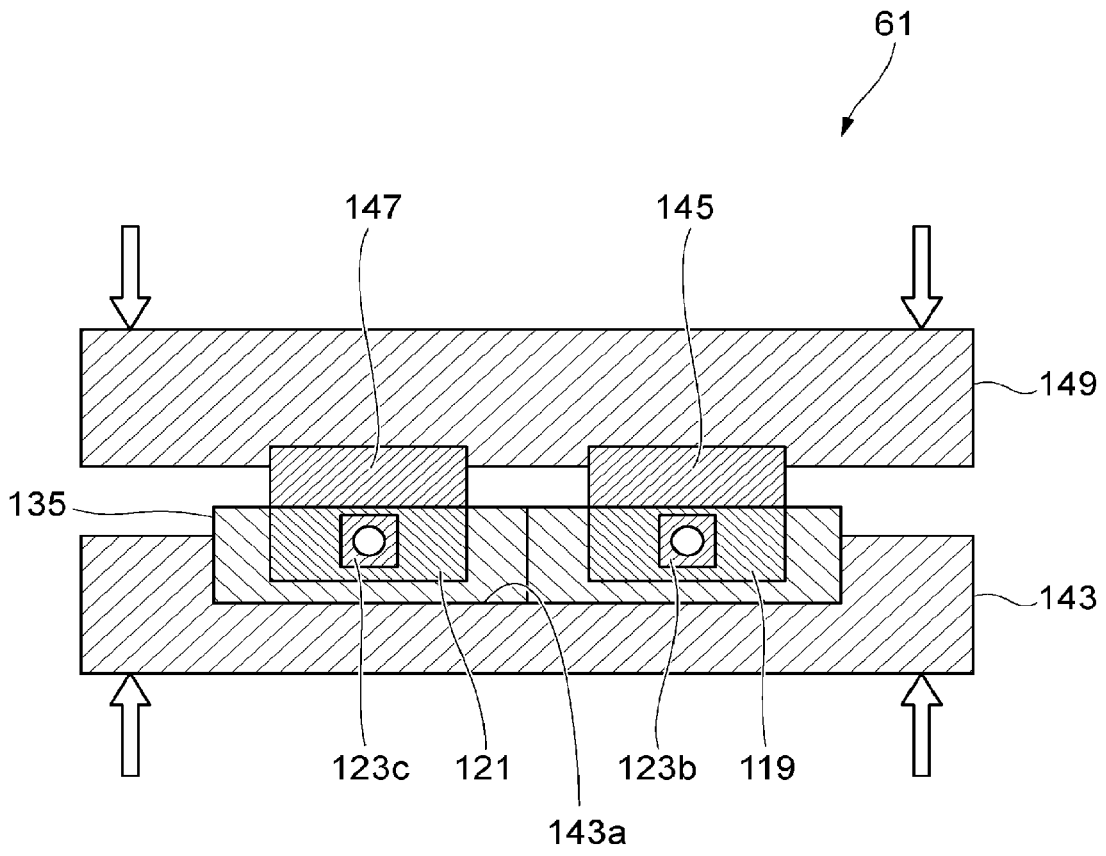
FIG. 10 is a schematic sectional view illustrating a state in which the coil-side terminal support portion illustrated in FIG. 8 is sandwiched between a support stand and a pressing member.

FIG. 10 is a schematic sectional view illustrating a state in which the coil-side terminal support portion 135 illustrated in FIG. 8 is sandwiched between a support stand 143 and a pressing member 149.

The coil-side terminal support portion 135 is held in the terminal connection portion 61 in a sandwiched state. The terminal connection portion 61 includes the support stand 143 having a support surface 143*a* that supports the lower side of the coil-side terminal support portion 135, the pressing member 149 disposed above the support stand 143 in an opposing relation to the coil-side terminals 119 and 121, and a not-illustrated clamp for sandwiching the coil-side terminal support portion 135 between the pressing member 149 and the support stand 143.

Power supply-side terminals 145 and 147 for current supply are fixed to the pressing member 149. The power supply-side terminals 145 and 147 are arranged apart from each other in such a state that the lower sides thereof including flat lower surfaces are exposed from the pressing member 149. By clamping the pressing member 149 to the support stand 143 with the not-illustrated clamp, the power supply-side terminal 145 and the power supply-side terminal 147 are press-contacted and electrically conducted to the coil-side terminal 119 and the coil-side terminal 121, respectively.

<Coil Moving Mechanisms>

The coil moving mechanisms will be described below.

Bases 69A and 69B are disposed on both the sides of the jig plate 31 in the tube expansion stage ST2 illustrated in FIG. 2. The first coil moving mechanism 37A supporting the first coil unit 30A is disposed on the base 69A, and the second coil moving mechanism 37B supporting the second coil unit 30B is disposed on the base 69B.

The first coil moving mechanism 37A includes a chucking portion 38A made of an electrically insulating material and grasping the first coil unit 30A, and a not-illustrated drive portion such as a ball spline. The drive portion drives the first coil unit 30A to be movable back and forth in the axial direction. Similarly, the second coil moving mechanism 37B includes a chucking portion 38B made of an electrically insulating material and grasping the second coil unit 30B, and a not-illustrated drive portion like the above-described one. The drive portion drives the second coil unit 30B to be movable back and forth in the axial direction.

The first coil moving mechanism 37A inserts the first coil unit 30A into the aluminum tube member 13 coaxially with the aluminum tube member 13. The second coil moving mechanism 37B inserts the second coil unit 30B into the aluminum tube member 13 coaxially with the aluminum tube member 13. Operations of inserting the first coil unit 30A and the second coil unit 30B may be performed at the same time or at different timings shifted from each other.

With the movement of the first coil unit 30A by the first coil moving mechanism 37A and the movement of the second coil unit 30B by the second coil moving mechanism 37B, the first electromagnetic forming coil portion 29A and the second electromagnetic forming coil portion 29B are placed at desired positions where tube expansion is to be performed.

<Current Supply Units>

The current supply unit 39A includes a terminal connection portion 61A, a power supply portion 63A, and a high-voltage power supply cable 65A. The terminal connection portion 61A supplies a current for the electromagnetic forming to the first electromagnetic forming coil portion 29A and is connected to the above-mentioned coil-side terminals 119 and 121 (see FIG. 4) that are disposed on the base end side of the first coil unit 30A. The high-voltage power supply cable 65A connects the power supply portion 63A and the terminal connection portion 61A. The current supply unit 39B includes a terminal connection portion 61B, a power supply portion 63B, and a high-voltage power supply cable 65B. The terminal connection portion 61B supplies a current for the electromagnetic forming to the second electromagnetic forming coil portion 29B and is connected to the coil-side terminals 119 and 121 that are disposed on the base end side of the second coil unit 30B. The high-voltage power supply cable 65B connects the power supply portion 63B and the terminal connection portion 61B.

The power supply portions 63A and 63B output energy charged in capacitors as pulse-shaped large currents for a very short time within several milliseconds (ms) through switches. The output pulse currents are supplied to the first electromagnetic forming coil portion 29A and the second electromagnetic forming coil portion 29B through the high-voltage power supply cables 65A and 65B.

For example, a gap switch, a thyratron switch, a mechanical switch, a semiconductor switch, or an ignitron switch may be used as each of the above-mentioned switches.

<Jig Plate Transport Mechanism>

The jig plate transport mechanism 33 includes a pair of transport rails 34 and a transport conveyor (not illustrated) disposed along the transport rails 34 and constituted by a circulating conveyor chain. The jig plate 31 is placed on the transport conveyor and is transported along the transport rails 34 with driving of the conveyor chain. In other words, the jig plate transport mechanism 33 transports the jig plate 31 from the tube insertion stage ST1 to the tube expansion stage ST2 along the transport rails 34.

In addition to the above-described method, other various transport methods, such as a belt transport method and a walking beam method, can also be used for the jig plate transport mechanism 33. From the viewpoint of space saving of equipment and shortening of a tact time, the tube insertion stage ST1 and the tube expansion stage ST2 are preferably arranged side by side such that the tube insertion direction and the back-forth movement direction (axial direction) of the coil unit are parallel to each other. Furthermore, the jig plate 31 is preferably transported in a direction perpendicular to the axial direction.

<Electromagnetic Forming Step of Aluminum Tube Member>

Steps of a formed-article producing method for performing the electromagnetic forming of the aluminum tube member 13, illustrated in FIG. 1, by the above-described electromagnetic forming apparatus 100 will be described below in sequence.

Figure 11A:
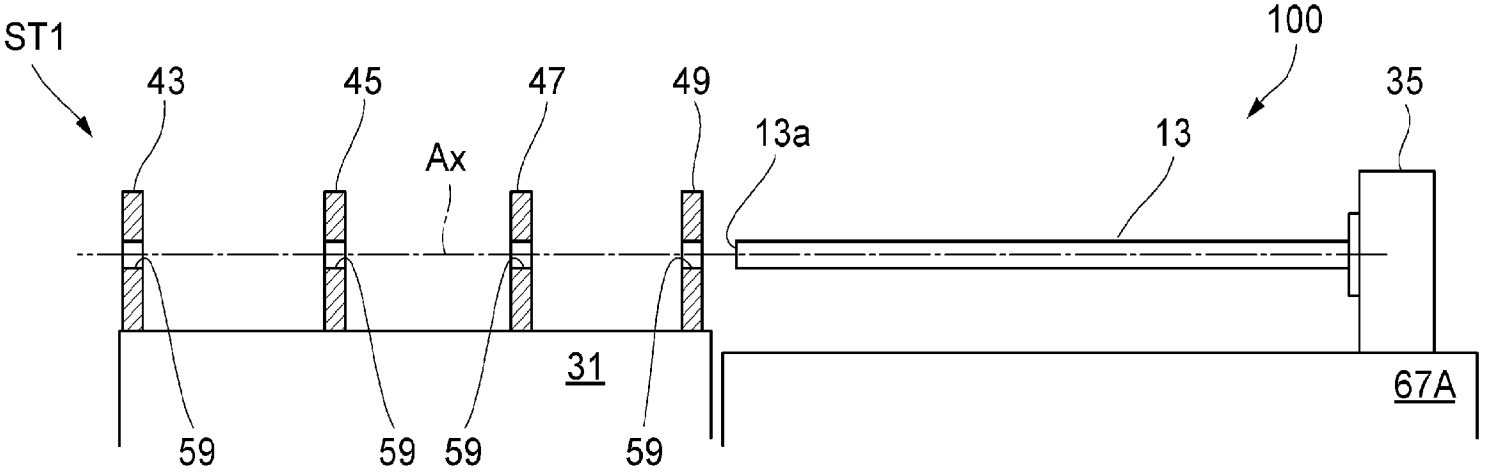
FIG. 11A is a step explanatory view stepwisely illustrating a tube insertion step of inserting an aluminum tube member into support members of the jig plate.
Figure 11B:
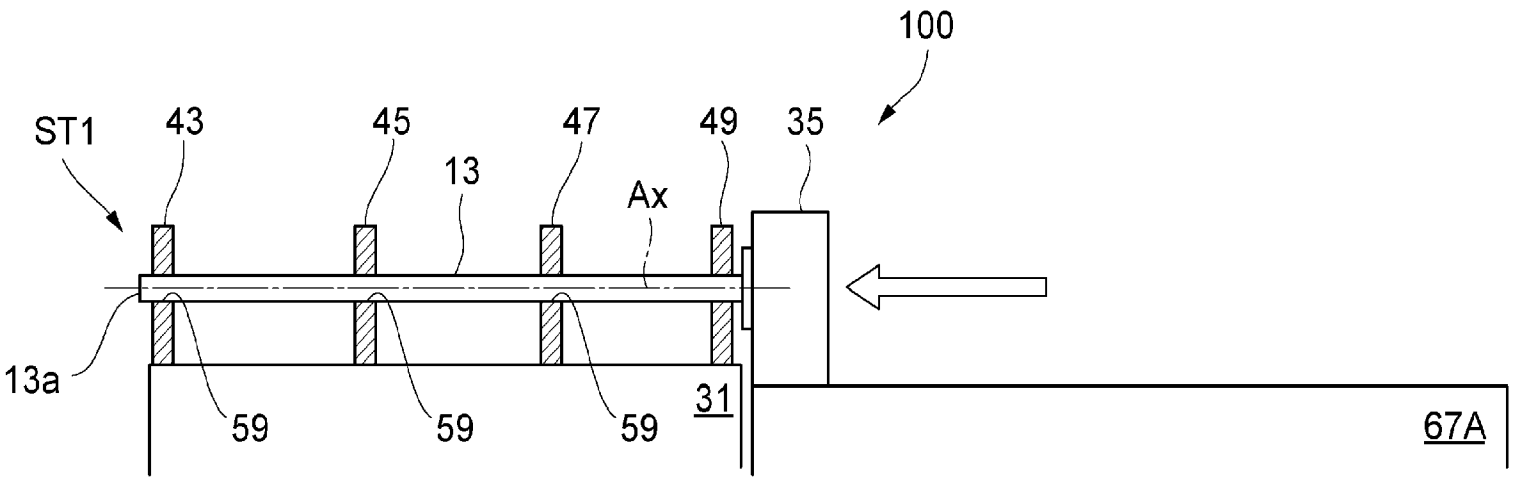
FIG. 11B is a step explanatory view stepwisely illustrating the tube insertion step of inserting the aluminum tube member into the support members of the jig plate.

FIGS. 11A and 11B are step explanatory views stepwisely illustrating a tube insertion step of inserting the aluminum tube member 13 into the support members 43, 45, 47 and 49 of the jig plate.

First, the aluminum tube member 13 is prepared and attached to the chucking mechanism equipped in the tube insertion mechanism 35 as illustrated in FIG. 11A.

The brackets 19A, 17, 15 and 19B (see FIG. 3) are attached respectively to the support members 43, 45, 47 and 49 of the jig plate 31. The brackets are fixed to the bracket holders 51, 53, 55 and 57 such that their through-holes 59 are positioned in a coaxially aligned state. In other words, the aluminum tube member 13 and the through-holes 59 of the support members 43, 45, 47 and 49 are coaxially arranged with an axis Ax being an axial center.

(Tube Insertion Step and Tube Member Placement Step)

Next, as illustrated in FIG. 11B, the aluminum tube member 13 is moved toward the jig plate 31 by driving the tube insertion mechanism 35. Thus, the aluminum tube member 13 is inserted, with a tube end 13*a* being ahead, through the through-holes 59 of the support member 49, the support member 47, the support member 45, and the support member 43 in order, and is placed at a position where the tube end 13*a* projects from the through-hole 59 of the support member 43. As a result, the support members 43, 45, 47 and 49 each surrounding the aluminum tube member 13 in a circumferential direction are arranged around the outer periphery of the aluminum tube member 13 at positions where tube expansion is to be performed.

In such a manner, positioning of the aluminum tube member 13 is made while it is held by the support members 43, 45, 47 and 49 in a high-accurately coaxially aligned state with the axis Ax being the axial center. After transferring the aluminum tube member 13 onto the jig plate 31, the tube insertion mechanism 35 is moved back to a retracted position illustrated in FIG. 11A.

(Coil Placement Step and Tube Expansion Step)

Next, the jig plate 31 on which the aluminum tube member 13 has been supported as described above in the tube insertion stage ST1 illustrated in FIG. 2 is transported to the tube expansion stage ST2 by the jig plate transport mechanism 33.

In the tube expansion stage ST2, a coil placement step of inserting the electromagnetic forming coil portions into the aluminum tube member 13, which is supported on the jig plate 31, from both ends in the axial direction and a tube expansion step of expanding the aluminum tube member 13 are performed.

Figure 12A:
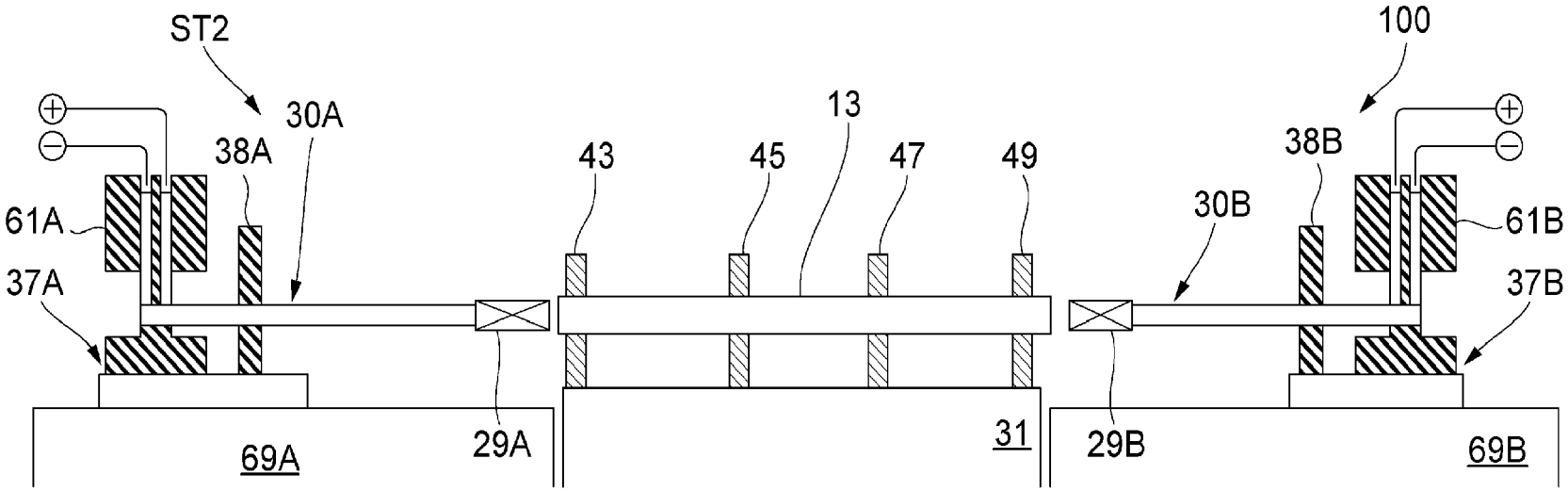
FIG. 12A is a step explanatory view stepwisely illustrating a coil placement step and a tube expansion step.
Figure 12B:
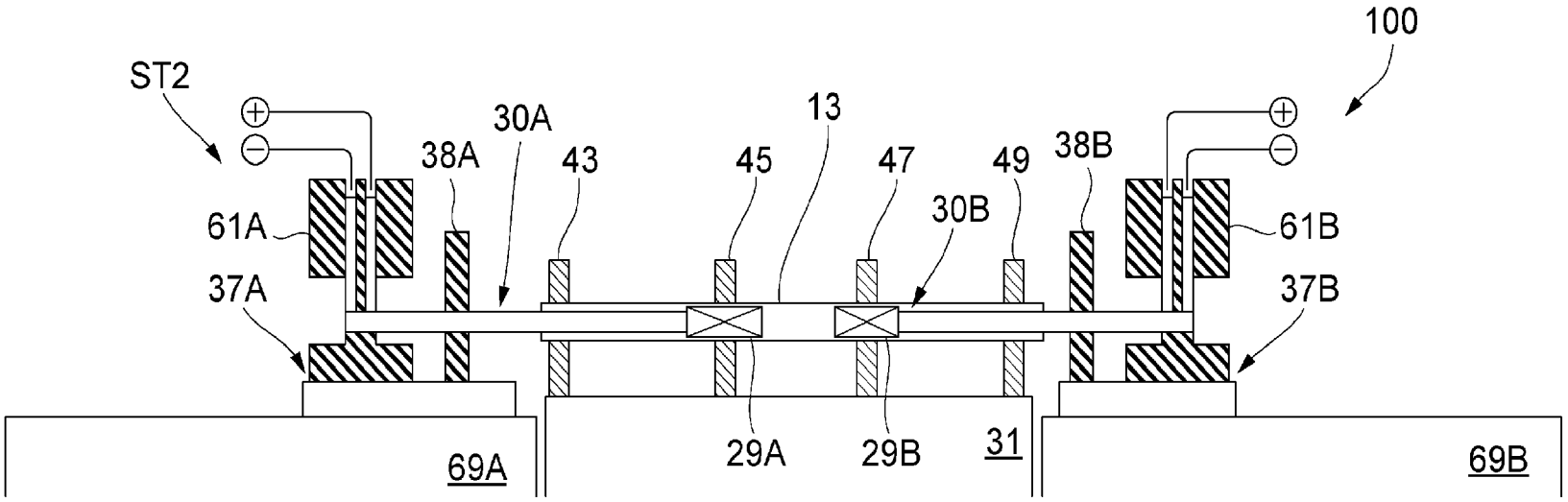
FIG. 12B is a step explanatory view stepwisely illustrating the coil placement step and the tube expansion step.
Figure 12C:
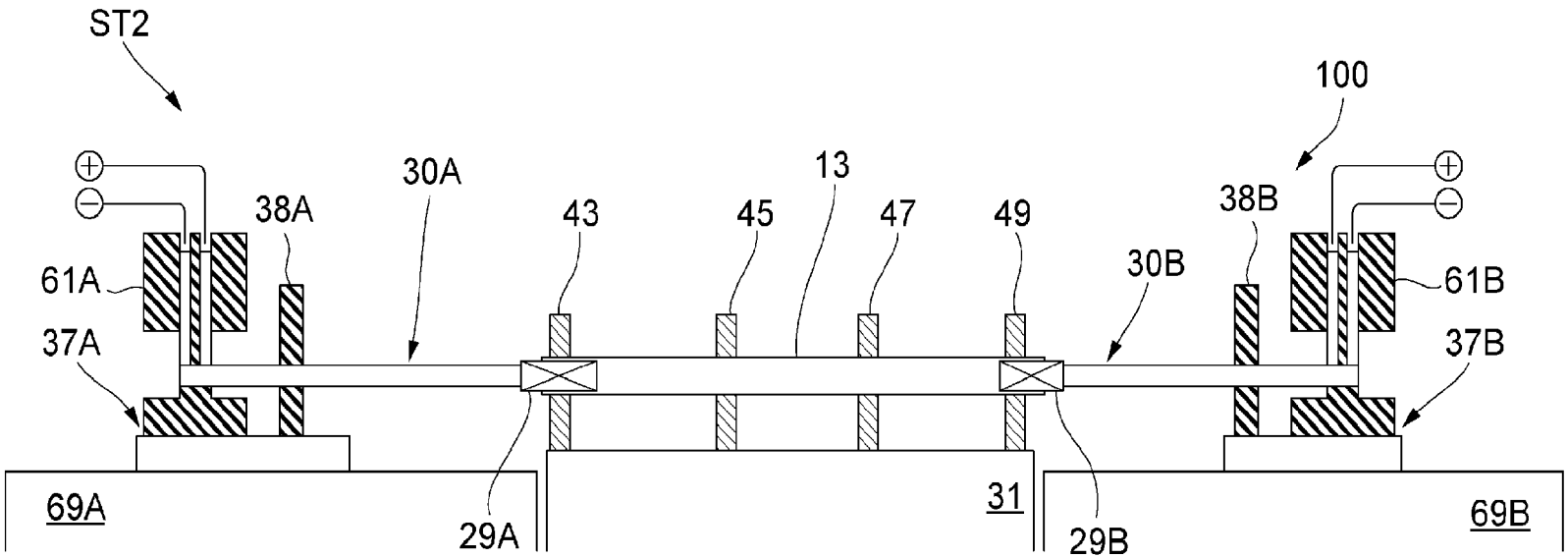
FIG. 12C is a step explanatory view stepwisely illustrating the coil placement step and the tube expansion step.

FIGS. 12A, 12B and 12C are step explanatory views stepwisely illustrating the coil placement step and the tube expansion step.

As illustrated in FIG. 12A, the first coil unit 30A supported by the chucking portion 38A of the first coil moving mechanism 37A and the second coil unit 30B supported by the chucking portion 38B of the second coil moving mechanism 37B are coaxially arranged in an opposing relation with respect to the jig plate 31 that has been transported to the tube expansion stage ST2.

Then, as illustrated in FIG. 12B, the first coil moving mechanism 37A and the second coil moving mechanism 37B move respectively the first coil unit 30A and the second coil unit 30B toward the jig plate 31. The first electromagnetic forming coil portion 29A disposed at the fore end of the first coil unit 30A is placed at an axial position of the support member 45, i.e., at a processing position, and the second electromagnetic forming coil portion 29B disposed at the fore end of the second coil unit 30B is placed at an axial position of the support member 47, i.e., at a processing position.

Next, in the state illustrated in FIG. 12B, currents are supplied to the first electromagnetic forming coil portion 29A and the second electromagnetic forming coil portion 29B from the current supply units 39A and 39B (see FIG. 2). As a result, at the position of the support member 45 and the position of the support member 47, the aluminum tube member 13 is expanded by the electromagnetic forming, and is fixedly crimped to the support members 45 and 47 with the tube expansion.

Furthermore, as illustrated in FIG. 12C, the first coil unit 30A is moved in the axial direction by the first coil moving mechanism 37A to place the first electromagnetic forming coil portion 29A at an axial position of the support member 43, i.e., at a processing position. The second coil unit 30B is moved in the axial direction by the second coil moving mechanism 37B to place the second electromagnetic forming coil portion 29B at an axial position of the support member 49, i.e., at a processing position.

In the above-mentioned state, currents are supplied to the first electromagnetic forming coil portion 29A and the second electromagnetic forming coil portion 29B from the current supply units 39A and 39B (see FIG. 2). As a result, at the positions of the support members 43 and 49, the aluminum tube member 13 is expanded by the electromagnetic forming and is fixed to the support members 43 and 49 by crimping.

Through the above-described steps, the aluminum tube member 13 is fixed to the brackets 15, 17, 19A and 19B (see FIG. 3) by crimping.

Figure 13A:
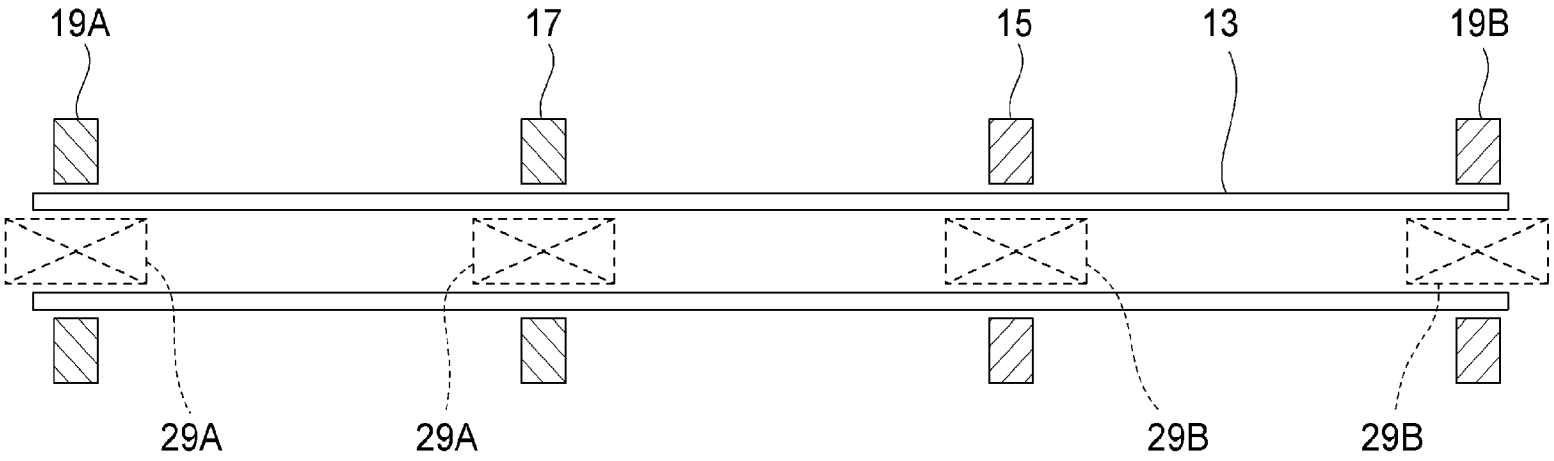
FIG. 13A is a sectional view of the aluminum tube member before electromagnetic forming.
Figure 13B:
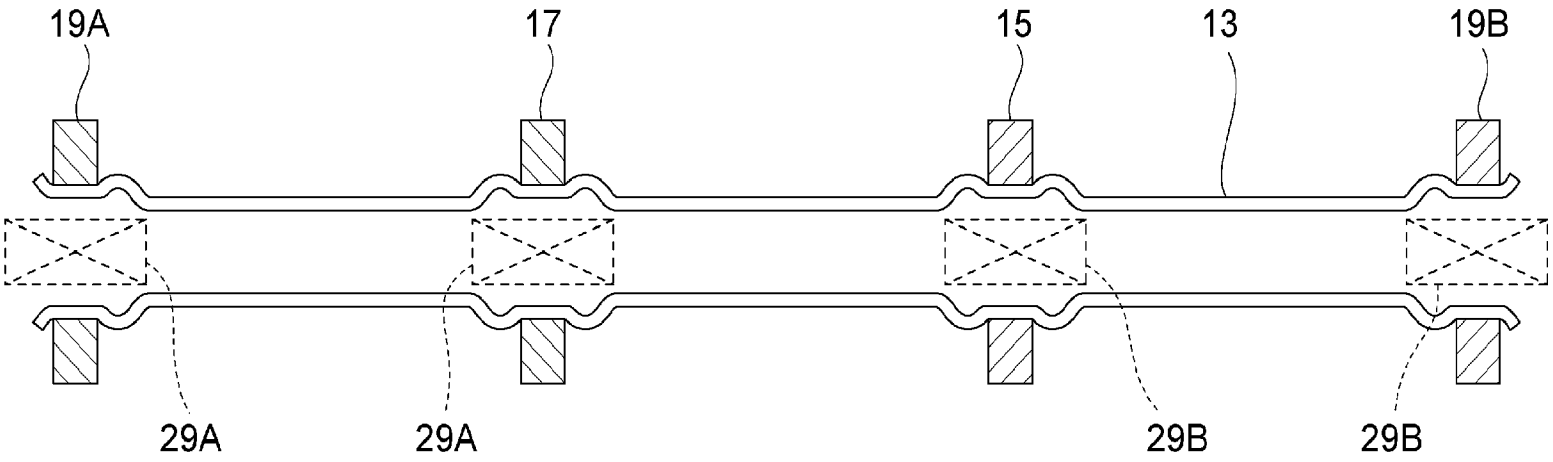
FIG. 13B is a sectional view of the aluminum tube member after the electromagnetic forming.

FIG. 13A is a sectional view of the aluminum tube member 13 before the electromagnetic forming, and FIG. 13B is a sectional view of the aluminum tube member 13 after the electromagnetic forming.

The aluminum tube member 13 after the electromagnetic forming is expanded at the above-described positions where the first electromagnetic forming coil portion 29A and the second electromagnetic forming coil portion 29B are placed. More specifically, the aluminum tube member 13 is expanded by the electromagnetic forming and is bulged outward in the radial direction over the entire periphery at positions axially outward of the brackets 15, 17, 19A and 19B, whereby the aluminum tube member 13 is fixed by crimping. As a result, the formed article 11 in the state illustrated in FIG. 1 is obtained.

After the above-described electromagnetic forming, the bracket holders 51, 53, 55 and 57 of the support members 43, 45, 47 and 49 illustrated in FIG. 3 are released from the fixed state, and the formed article 11 including the brackets 15, 17, 19A and 19B fixed in place by crimping is taken out.

The formed article 11 may be taken out in the tube expansion stage ST2 illustrated in FIG. 2. Alternatively, the jig plate 31 may be transported by the jig plate transport mechanism 33 to a further advanced position in a transport direction, and the formed article 11 may be taken out at a position downstream of the tube expansion stage ST2 in the transport direction.

In the electromagnetic forming apparatus 100 for the aluminum tube member according to this structure example, the first electromagnetic forming coil portion 29A and the second electromagnetic forming coil portion 29B each being shorter than the entire length of the aluminum tube member 13 are placed at the desired forming positions, and the aluminum tube member 13 is expanded there by the electromagnetic forming. Thus, a loss of the current flowing in the electromagnetic forming coil portion can be reduced in comparison with that in the case of placing the electromagnetic forming coil portion over the entire length of the aluminum tube member 13. It is hence possible to flow a required amount of current at the position where the tube expansion needs to be performed by the electromagnetic forming, and to prevent the occurrence of variation in the degree of the electromagnetic forming of the aluminum tube member 13. As a result, the electromagnetic forming with high accuracy can be achieved. In addition, the brackets 15, 17, 19A and 19B are high-accurately and firmly fixed to the aluminum tube member 13 by crimping at the positions where the brackets are arranged.

During the tube expansion, because currents in opposite directions flow in the conductor extension portion 123*b* and the conductor extension portion 123*c*, vibrations generate in the conductor extension portions 123*b* and 123*c*. If contact, of the conductor extension portions 123*b* and 123*c* with the aluminum tube member 13 or contact between the conductor extension portions 123*b* and 123*c*, for example, is caused by those vibrations, a short circuit or a spark occurs between the conductors.

However, the conductor extension portions 123*b* and 123*c* according to this structure example are held (fixed) in the state apart from each other through a certain distance with the presence of the grooves 127 and 129 (see FIG. 7) formed in the insulating support 117. Thus, even when the vibrations generate during energization for the electromagnetic forming, the conductor extension portions 123*b* and 123*c* are kept from slipping out of the grooves 127 and 129, and the occurrence of a short circuit or a spark is reliably prevented.

Furthermore, in the electromagnetic forming, a work, i.e., a forming target, is placed near the coil unit, and energy charged in a capacitor is supplied to the coil unit through the high-voltage power supply cables 65A and 65B (see FIG. 2). On that occasion, if gaps are present between the power supply-side terminals 145, 147 connected to the high-voltage power supply cables 65A, 65B and the coil-side terminals 119, 121 (see FIG. 10), there is a possibility that sparks may generate across the gaps, thus causing fusion of terminal surfaces, joining between the terminals, etc. In such a case, replacement of the power supply-side terminals 145 and 147 of the high-voltage power supply cables 65A and 65B and the coil-side terminals 119 and 121 is necessitated, and productivity is reduced.

However, the power supply-side terminals 145 and 147 and the coil-side terminals 119 and 121 in this structure example each have a plate-shaped terminal structure, and they are brought into a surface contact state in which the terminals are placed one above the other. By fixing the terminals in the surface contact state and supplying the current in that state, more reliable contact is obtained between the terminals, and the occurrence of a spark between the terminals can be prevented. Moreover, because of the terminal structure, the power supply-side terminals 145 and 147 and the coil-side terminals 119 and 121 can be separated from each other by simple operation, and the electromagnetic forming coil unit 30 can be transferred to a next electromagnetic forming step. Hence the degree of freedom in the electromagnetic forming step is increased, and productivity is improved.

<Second Structure Example of Electromagnetic Forming Coil Unit>

A second structure example of the electromagnetic forming coil unit will be described below.

Figure 14:
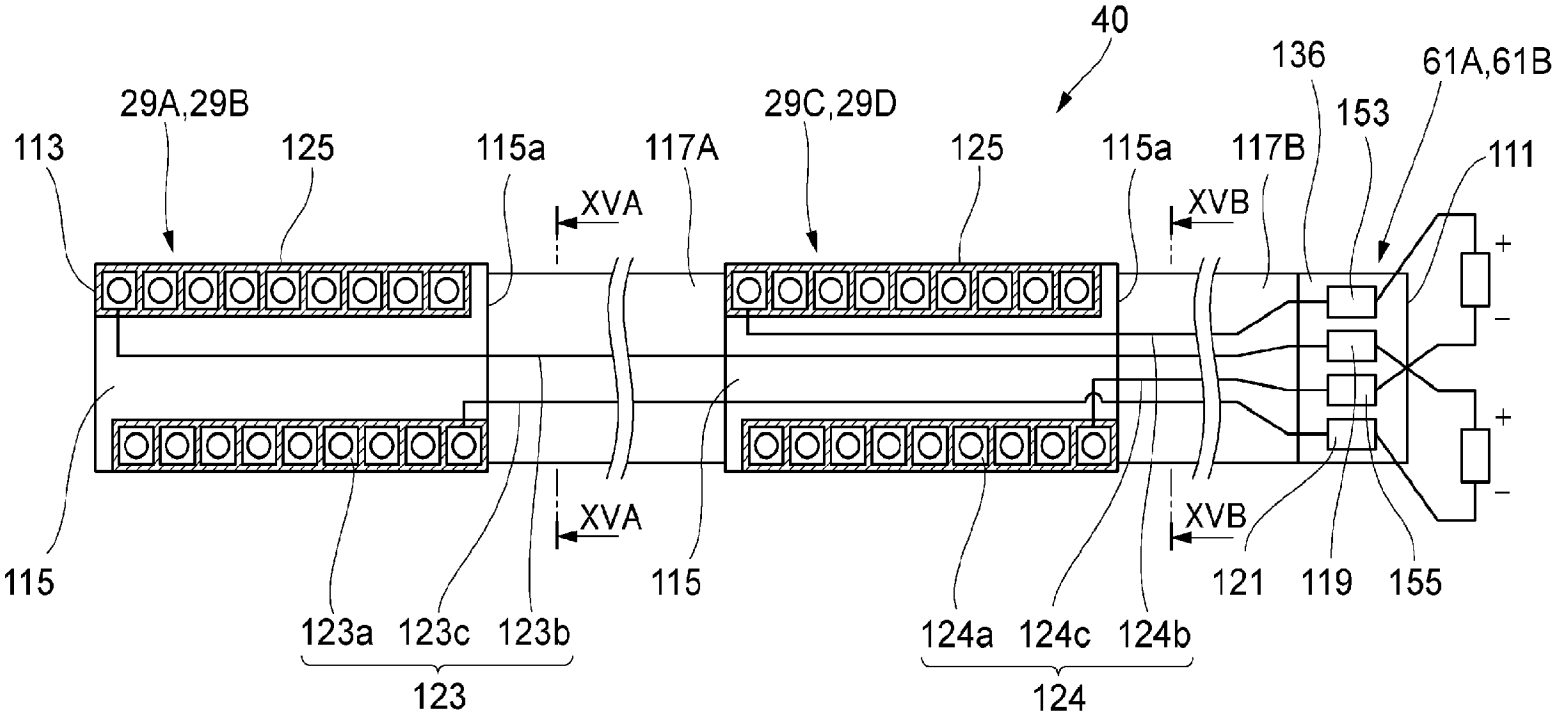
FIG. 14 is a schematic structural view of an electromagnetic forming coil unit according to a second structure example.

FIG. 14 is a schematic structural view of an electromagnetic forming coil unit 40 according to the second structure example.

In the electromagnetic forming coil unit 40 according to this structure example, a first electromagnetic forming coil portion 29A and a third electromagnetic forming coil portion 29C are disposed at plural positions (two for each coil unit in the illustrated example) along the axial direction. Though described later in detail, when the electromagnetic forming coil unit 40 according to the second structure example is used in pair, a second electromagnetic forming coil portion 29B and a fourth electromagnetic forming coil portion 29D in the other electromagnetic forming coil unit have similar structures to those of the first electromagnetic forming coil portion 29A and the third electromagnetic forming coil portion 29C.

The first electromagnetic forming coil portion 29A and the third electromagnetic forming coil portion 29C are independent coil units and are individually energized. An insulating support 117A is disposed between the first electromagnetic forming coil portion 29A and the third electromagnetic forming coil portion 29C, and an insulating support 117B is disposed between the third electromagnetic forming coil portion 29C and the base end 111.

The electromagnetic forming coil unit 40 has a similar structure to that of the above-described electromagnetic forming coil unit 30 except for the above point. In the following, the same components and portions are denoted by the same reference numerals, and description of those components and portions is simplified or omitted.

Conductor extension portions 123*b* and 123*c* from the first electromagnetic forming coil portion 29A are arranged in the insulating support 117A and a shaft core member 115 of the third electromagnetic forming coil portion 29C to extend along their axes. Conductor extension portions 124*b* and 124*c* from the third electromagnetic forming coil portion 29C are arranged in the shaft core member 115 of the third electromagnetic forming coil portion 29C and the insulating support 117B to extend parallel to the conductor extension portions 123*b* and 123*c*.

In a terminal connection portion 61A, a base end of the conductor extension portion 124*b* is connected to a coil-side terminal 153, and a base end of the conductor extension portion 124*c* is connected to a coil-side terminal 155. Not-illustrated grooves for holding (fixing) the conductor extension portions 123*b* and 123*c* are formed in the shaft core member 115 of the first electromagnetic forming coil portion 29A. Similarly, not-illustrated grooves for holding (fixing) the conductor extension portions 123*b* and 123*c* and the conductor extension portions 124*b* and 124*c* are formed in the shaft core member 115 of the third electromagnetic forming coil portion 29C.

Figure 15A:
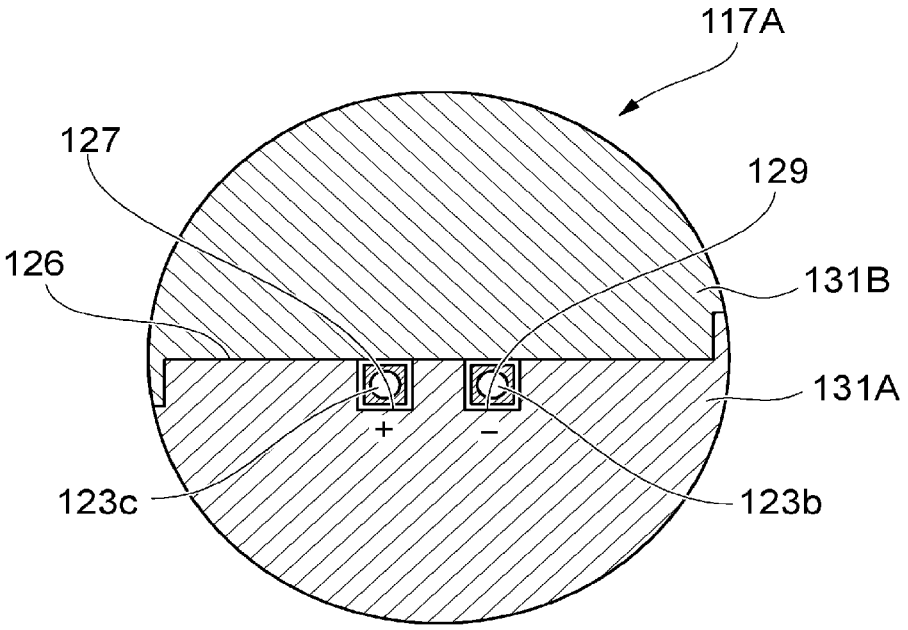
FIG. 15A is a sectional view, taken along line XVA-XVA, of an insulating support illustrated in FIG. 14.
Figure 15B:
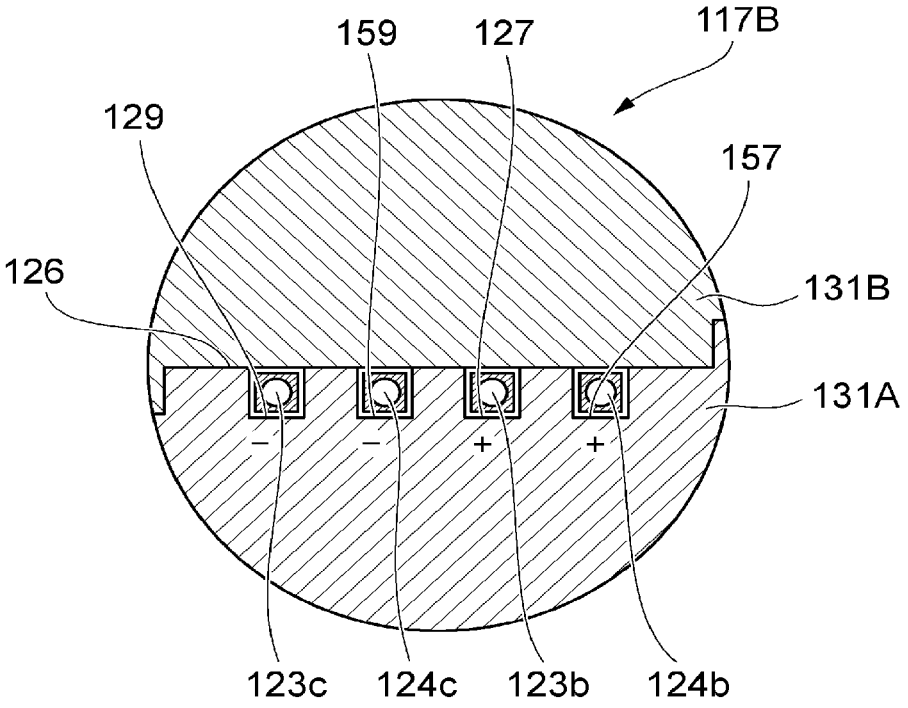
FIG. 15B is a sectional view, taken along line XVB-XVB, of the insulating support illustrated in FIG. 14.

FIG. 15A is a sectional view, taken along line XVA-XVA, of the insulating support 117A illustrated in FIG. 14, and FIG. 15B is a sectional view, taken along line XVB-XVB, of the insulating support 117B illustrated in FIG. 14.

In the insulating support 117A illustrated in FIG. 15A, as in the insulating support 117 (see FIG. 7) according to the first structure example, grooves (conductor holding portions) 127 and 129 for holding (fixing) the pair of the conductor extension portions 123*b* and 123*c* in a state apart from each other through a certain distance are formed in a split opposing surface 126 of one split piece 131A to extend in the longitudinal direction.

In the insulating support 117B illustrated in FIG. 15B, grooves (conductor holding portions) 127 and 129 for holding (fixing) the pair of the conductor extension portions

123*b* and 123*c* are formed in a split opposing surface 126 of one split piece 131A to extend in the longitudinal direction. Moreover, grooves (conductor holding portions) 157 and 159 for holding (fixing) the pair of the conductor extension portions 124*b* and 124*c* are formed in the split opposing surface 126.

Figure 16:
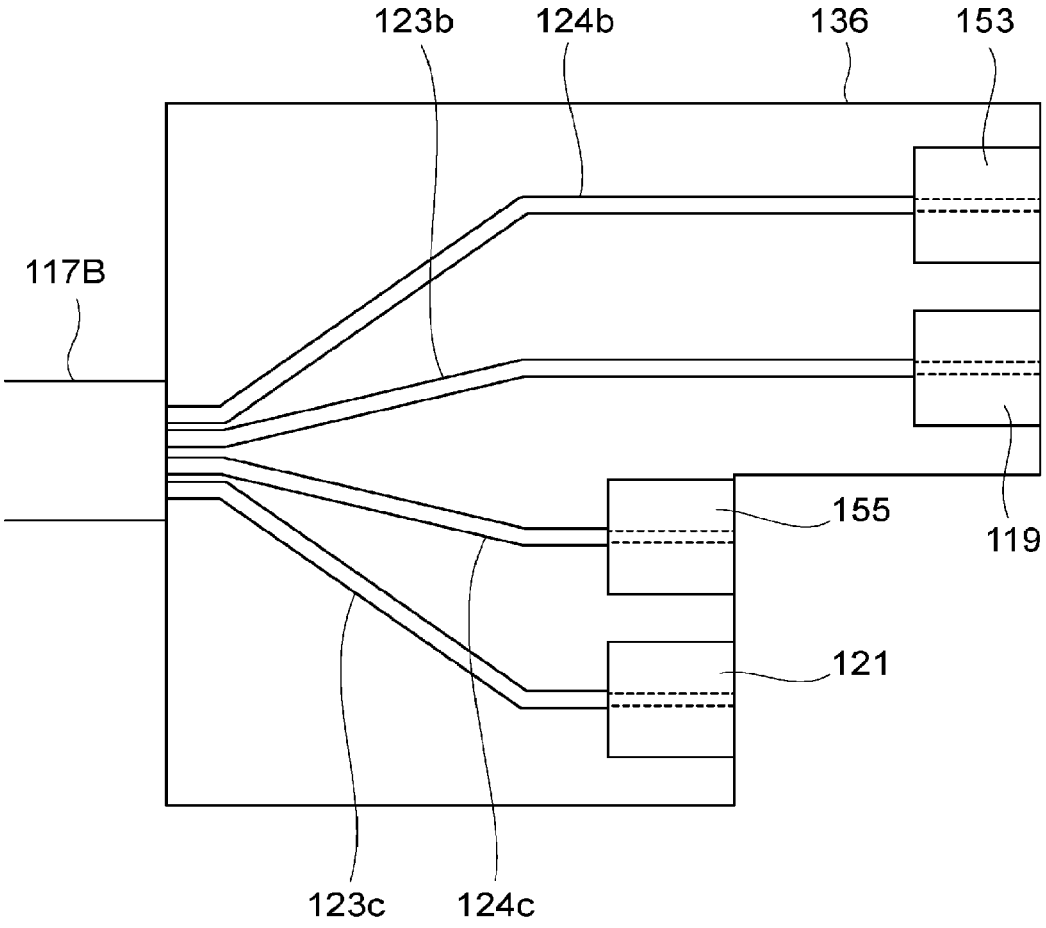
FIG. 16 is a plan view of a coil-side terminal support portion in the second structure example.

FIG. 16 is a plan view of a coil-side terminal support portion 136 in the second structure example.

Similarly to the coil-side terminal support portion 135 (see FIG. 8) according to the first structure example, the coil-side terminal support portion 136 has a stepped structure having different projection lengths in the longitudinal direction of the insulating support 117B. The coil-side terminals 153 and 119 are disposed in a portion of the stepped structure on the side having the longer projection length, and the coil-side terminal 155 and 121 are disposed in a portion of the stepped structure on the side having the shorter projection length. Similarly to the coil-side terminals 119 and 121, the coil-side terminals 153 and 155 are each formed of a plate-shaped metal piece and are fixedly held on the coil-side terminal support portion 136 apart from each other.

Figure 17:
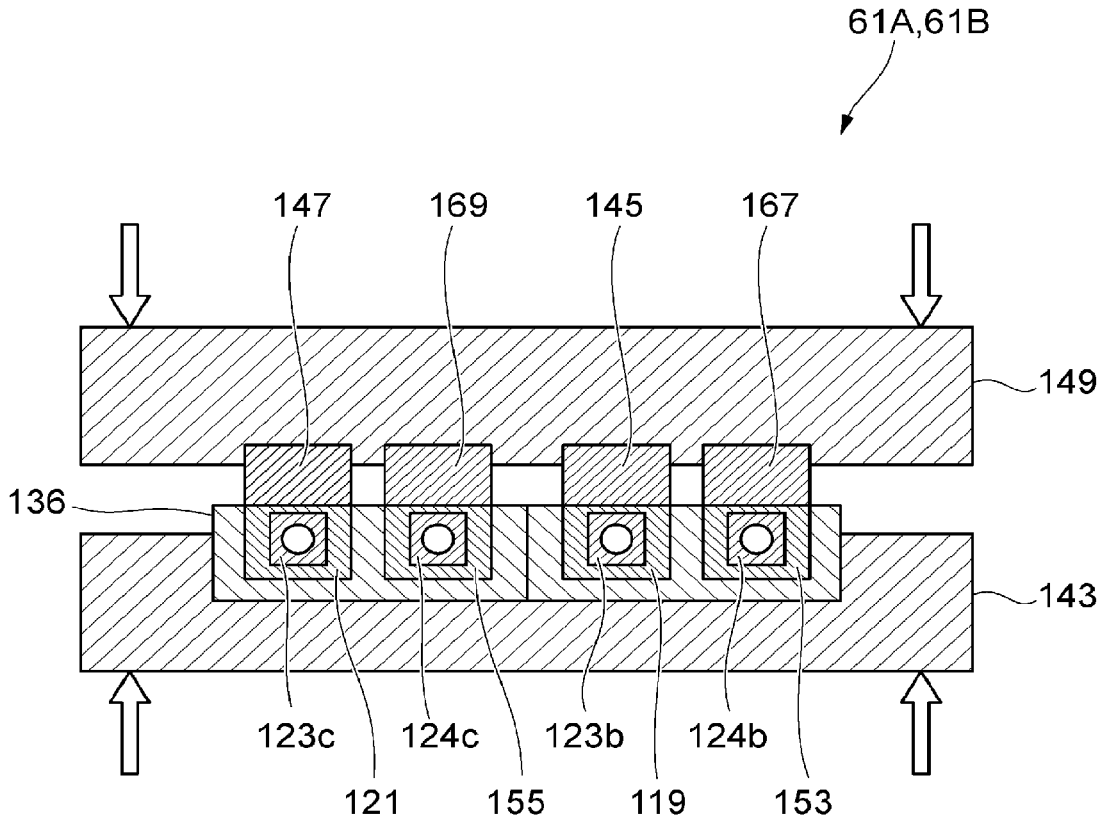
FIG. 17 is a schematic sectional view illustrating a state in which the coil-side terminal support portion illustrated in FIG. 16 is sandwiched between a support stand and a pressing member.

FIG. 17 is a schematic sectional view illustrating a state in which the coil-side terminal support portion 136 illustrated in FIG. 16 is sandwiched between a support stand 143 and a pressing member 149.

As in the first structure example, the coil-side terminal support portion 136 is held in the terminal connection portion 61A in a sandwiched state. Power supply-side terminals 145, 147, 167 and 169 are fixed to the pressing member 149. The power supply-side terminals 145, 147, 167 and 169 are arranged apart from each other in such a state that the lower sides thereof including flat lower surfaces are exposed from the pressing member 149. By clamping the pressing member 149 to the support stand 143 with a not-illustrated clamp, the power supply-side terminal 145 and the coil-side terminal 119, the power supply-side terminal 147 and the coil-side terminal 121, the power supply-side terminal 167 and the coil-side terminal 153, and the power supply-side terminal 169 and the coil-side terminal 155 are brought into contact and fixed to each other.

Figure 18A:
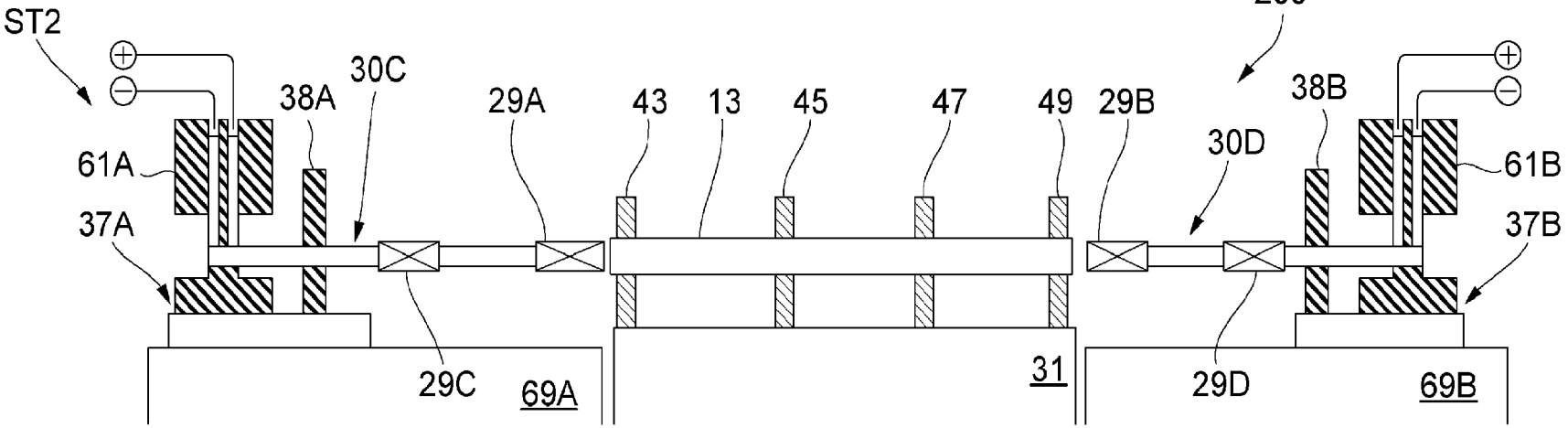
FIG. 18A is a step explanatory view stepwisely illustrating a tube expansion step of inserting electromagnetic forming coil portions into the aluminum tube member supported by the jig plate and expanding the aluminum tube member in an electromagnetic forming apparatus that includes the electromagnetic forming coil unit according to the second structure example.
Figure 18B:
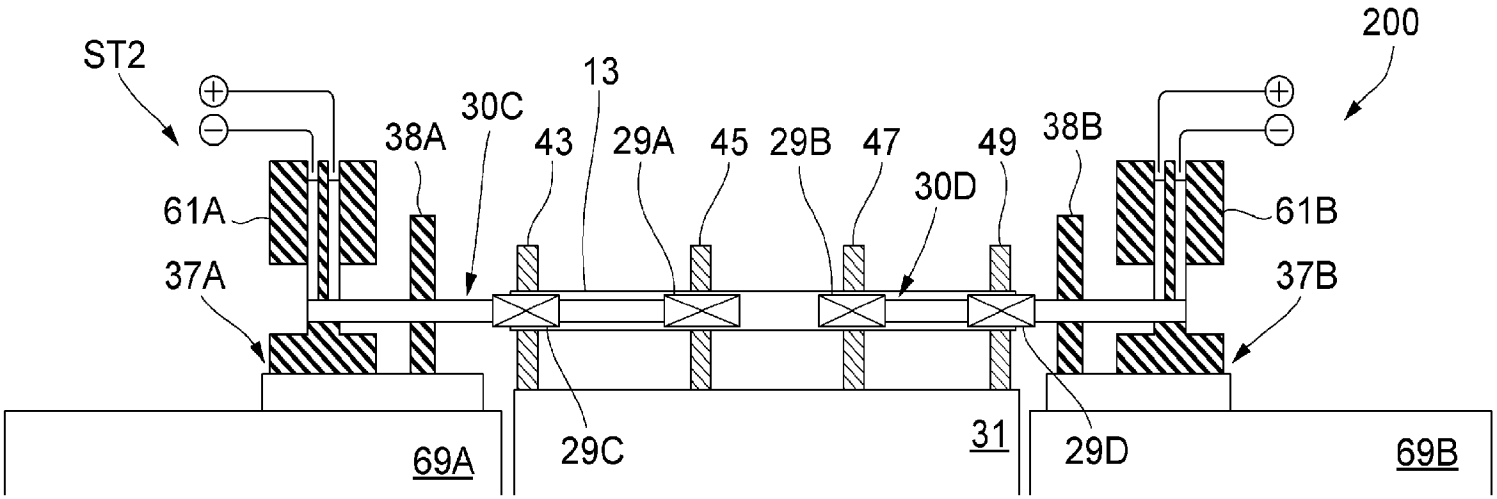
FIG. 18B is a step explanatory view stepwisely illustrating the tube expansion step of inserting the electromagnetic forming coil portions into the aluminum tube member that is supported by the jig plate, and expanding the aluminum tube member in the electromagnetic forming apparatus that includes the electromagnetic forming coil unit according to the second structure example.

FIGS. 18A and 18B are step explanatory views stepwisely illustrating a tube expansion step of inserting the electromagnetic forming coil portions into the aluminum tube member 13 that is supported by the jig plate 31, and expanding the aluminum tube member in an electromagnetic forming apparatus 200 that includes the electromagnetic forming coil unit according to the second structure example.

An electromagnetic forming apparatus 200 according to this structure example includes, instead of the first coil unit 30A and the second coil unit 30B (see FIG. 12A) in the above-described electromagnetic forming apparatus 100 according to the first structure example, a third coil unit 30C and a fourth coil unit 30D in each of which electromagnetic forming coil portions are disposed at plural positions (two for each coil unit in the illustrated example) along the axial direction. The remaining structure is similar to that of the above-described electromagnetic forming apparatus 100.

The third coil unit 30C in this structure example includes the first electromagnetic forming coil portion 29A and the third electromagnetic forming coil portion 29C arranged in this order from a fore end on the side closer to the jig plate 31. A portion of the third coil unit 30C between the first electromagnetic forming coil portion 29A and the third electromagnetic forming coil portion 29C and a portion thereof on the side closer to a base end than the third electromagnetic forming coil portion 29C are each made of a resin support. Conductors connected to coils are embedded in the resin support.

Similarly, the fourth coil unit 30D includes the second electromagnetic forming coil portion 29B and the fourth electromagnetic forming coil portion 29D arranged in this order from a fore end on the side closer to the jig plate 31. A portion of the fourth coil unit 30D between the second electromagnetic forming coil portion 29B and the fourth electromagnetic forming coil portion 29D and a portion thereof on the side closer to a base end than the fourth electromagnetic forming coil portion 29D are each made of a resin support. Conductors connected to coils are embedded in the resin support.

The distance between coil centers of the first electromagnetic forming coil portion 29A and the third electromagnetic forming coil portion 29C is set equal to the distance between the support member 43 and the support member 45, and the distance between coil centers of the second electromagnetic forming coil portion 29B and the fourth electromagnetic forming coil portion 29D is set equal to the distance between the support member 47 and the support member 49.

In the electromagnetic forming apparatus 200 according to this structure example, from the state illustrated in FIG. 18A, the third coil unit 30C is moved by the first coil moving mechanism 37A toward the jig plate 31 in the axial direction, and the fourth coil unit 30D is moved by the second coil moving mechanism 37B toward the jig plate 31 in the axial direction, as illustrated in FIG. 18B. With the movement of the third coil unit 30C, when the first electromagnetic forming coil portion 29A is placed at the axial position of the support member 45, the third electromagnetic forming coil portion 29C is placed at the axial position of the support member 43. With the movement of the fourth coil unit 30D, when the second electromagnetic forming coil portion 29B is placed at the axial position of the support member 47, the fourth electromagnetic forming coil portion 29D is placed at the axial position of the support member 49.

By energizing the electromagnetic forming coil portions 29A, 29B, 29C and 29D in the state illustrated in FIG. 18B, the aluminum tube member 13 is expanded by the electromagnetic forming at the axial positions of the support members 43, 45, 47 and 49 at once.

With the electromagnetic forming apparatus 200 according to this structure example, since the third coil unit 30C and the fourth coil unit 30D each including the plurality of electromagnetic forming coil portions disposed in series are used, the electromagnetic forming can be performed at the desired plural positions for the tube expansion without moving the coils. As a result, a coil movement time in the tube expansion step can be shortened and a tact time can be shortened. The electromagnetic forming coil portions 29A, 29B, 29C and 29D may be energized simultaneously or sequentially. In any case, the steps can be simplified with no need of moving the third coil unit 30C and the fourth coil unit 30D.

Furthermore, preferably, the conductor extension portions 123*b* and 123*c* and the conductor extension portions 124*b* and 124*c* are alternately arranged as illustrated in FIG. 15B instead of arranging them in the mentioned order. In more detail, the conductor extension portions are preferably arranged in order of the conductor extension portion 123*c* (negative pole), 124*c* (negative pole), 123*b* (positive pole), and 124*b* (positive pole) in an array direction in which they are to be laid side by side. With that arrangement, when the electromagnetic forming is simultaneously performed at two positions, electromagnetic force generated between the positive pole and the negative pole can be reduced in amount, corresponding to one set of the conductor extension portions (i.e., the conductor extension portions 123*c* (negative pole) and 124*b* (positive pole)). Even when the conductor extension portions are sequentially energized with a time lag, the positive pole and the negative pole are spaced from each other through a larger distance, and electromagnetic force generated by the conductor extension portions can be reduced. As a result, the short circuit or the spark caused by vibrations of the conductors 123 and 124 is harder to generate.

In addition to arranging the conductor extension portions 123*b* and 123*c* and the conductor extension portions 124*b* and 124*c* as described above, the coil-side terminals 119 and 153 and the coil-side terminals 121 and 155 are arranged, as illustrated in FIG. 16, to be deviated in a direction perpendicular to the array direction (i.e., in the longitudinal direction of the insulating support 117B). In other words, the coil-side terminals are arranged such that the distance between the coil-side terminals 119 (positive pole) and 121 (negative pole) and the distance between the coil-side terminals 153 (positive pole) and 155 (negative pole) are increased. With that arrangement, the short circuit or the spark is even harder to generate.

<Modification>

The grooves 127, 129, 157 and 159 of the insulating support 117B illustrated in FIG. 15B are formed in a constant groove depth from the split opposing surface 126, but they have different groove depths.

Figure 19:
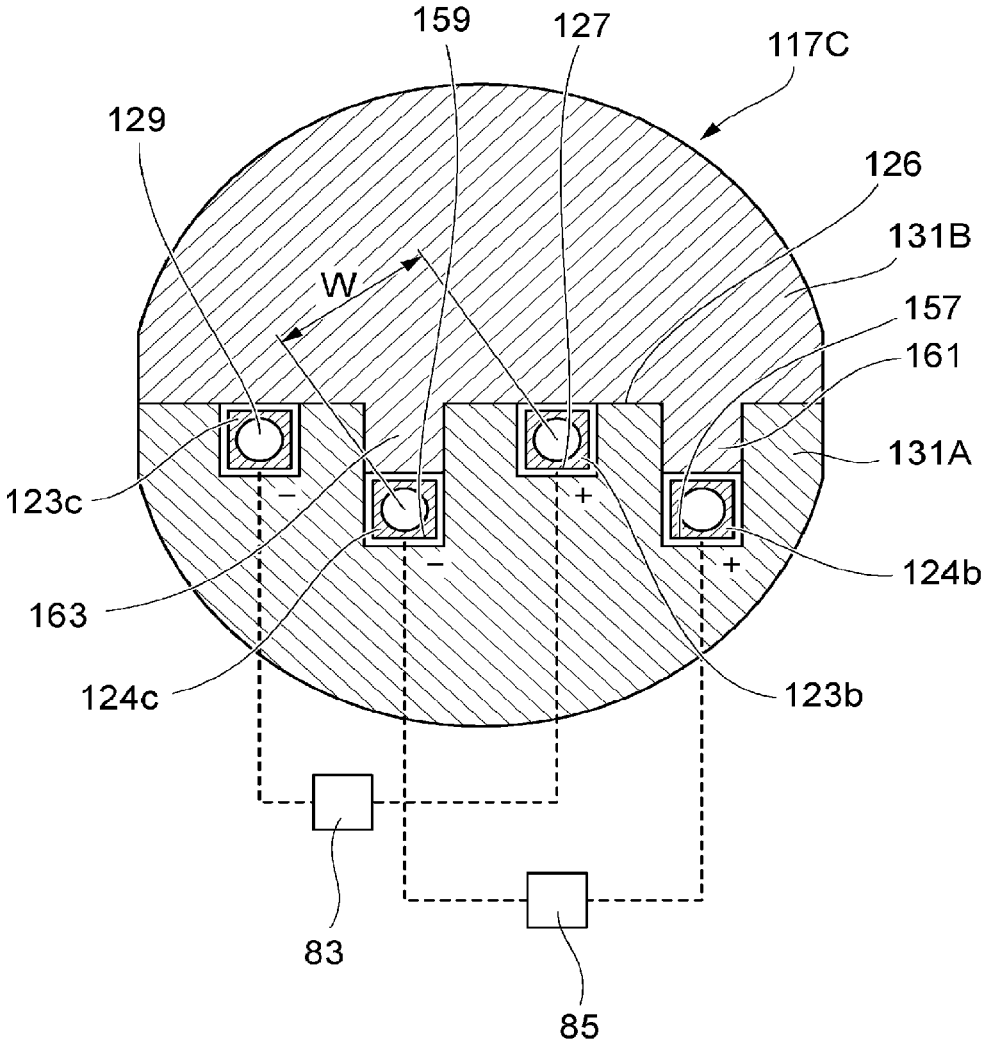
FIG. 19 is a sectional view illustrating a modification of the insulating support.

FIG. 19 is a sectional view illustrating a modification of the insulating support.

The insulating support 117C according to this modification is used instead of the insulating support 117B (see FIG. 14) at the same position, and the grooves 157 and 159 are formed to be deeper than the grooves 127 and 129. By changing the groove depths to be different alternately in such a fashion, a distance W between the positive pole and the negative pole can be increased in comparison with the case in which the grooves are arranged in parallel at the same groove depth. Hence the generated electromagnetic force can be reduced. In this modification, the conductor extension portions 123*b* (positive pole) and 123*c* (negative pole) are connected to the power supply unit 83, and the conductor extension portions 124*b* (positive pole) and 124*c* (negative pole) are connected to the power supply unit 85. In addition, corresponding to the deeper grooves 157 and 159, projections 161 and 163 are preferably formed to project from the split piece 131B and to be inserted to the grooves 157 and 159.

Although the grooves formed in the insulating support are continuous grooves extending in the axial direction, a hollow relay portion may be provided in part of the insulating support along the axial direction.

Figure 20:
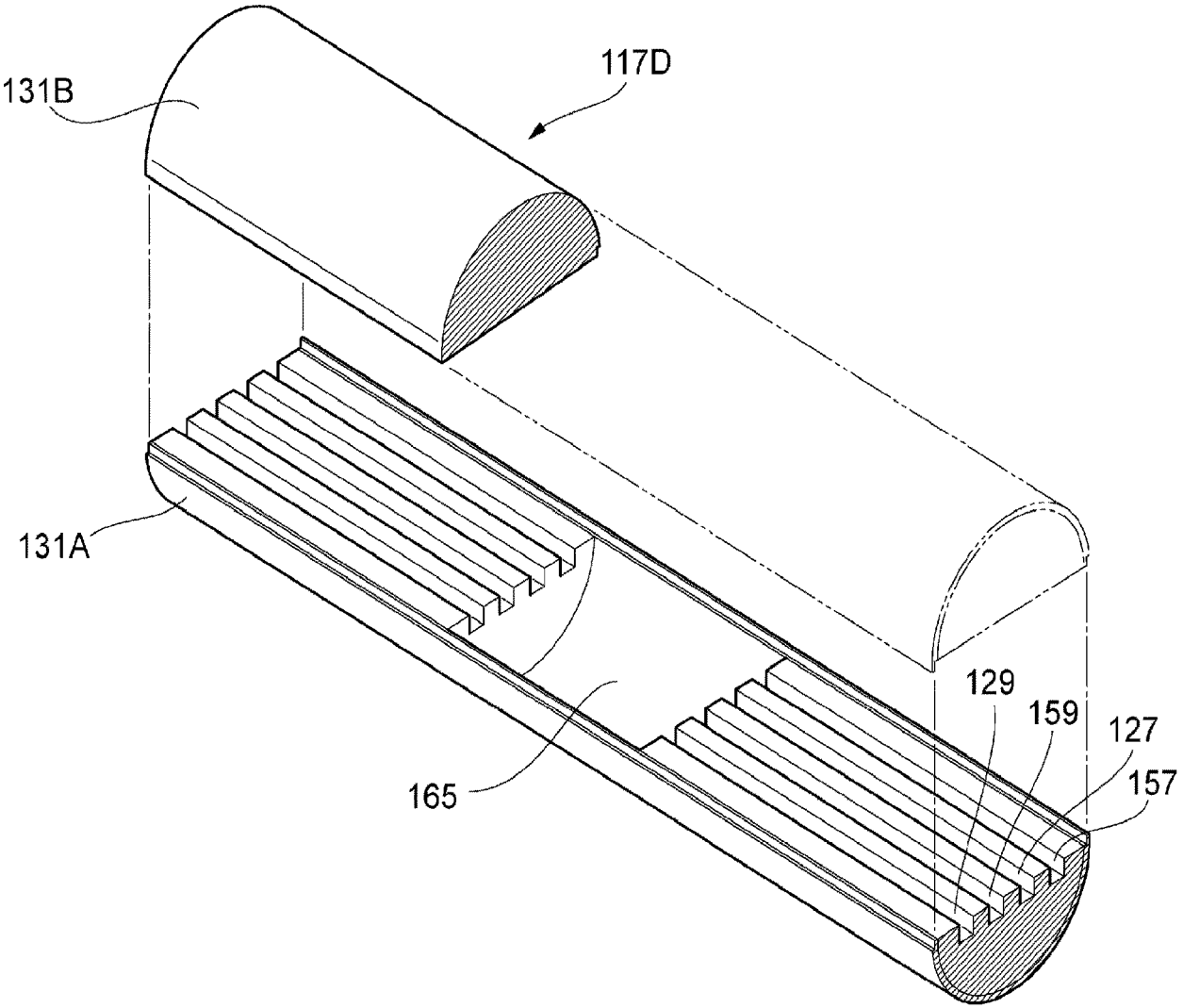
FIG. 20 is a perspective view of an insulating support, in a divided state, including a relay portion.

FIG. 20 is a perspective view of an insulating support 117D, in a divided state, including a relay portion 165.

In the relay portion 165, a space having a larger cross-sectional area than that of the groove is formed in at least one of the split pieces 131A and 131B. For example, when ends of each of not-illustrated conductors inserted in the grooves 129, 159, 127 and 157 are coupled to each other, the relay portion 165 serves as a space accommodating a coupling member such as a connection terminal.

The degree of freedom in layout and design of the conductors can be increased by arranging the relay portion 165 at the desired position of the insulating support.

In the electromagnetic forming coil unit, when plural coil portions are separately disposed, all the conductor extension portions need to be gathered within the winding diameter of each coil portion in consideration of the inner diameter of the tubular member. Accordingly, the spacing between the conductor extension portions is further narrowed, and the short circuit or the spark between the conductors caused by the vibrations of the conductors is more apt to generate. However, by arranging the conductor extension portions to be held in the grooves of the insulating support as in this structure example, the spacing between the conductors can be kept constant, and the conductors can be stably held even with the distance therebetween being short. Moreover, since the distance between two of the plural coil portions can be high-accurately set with the presence of the insulating support, the electromagnetic forming process can be performed with high dimensional accuracy.

<Third Structure Example of Electromagnetic Forming Apparatus>

A third structure example of the electromagnetic forming coil unit will be described below.

Figure 21:
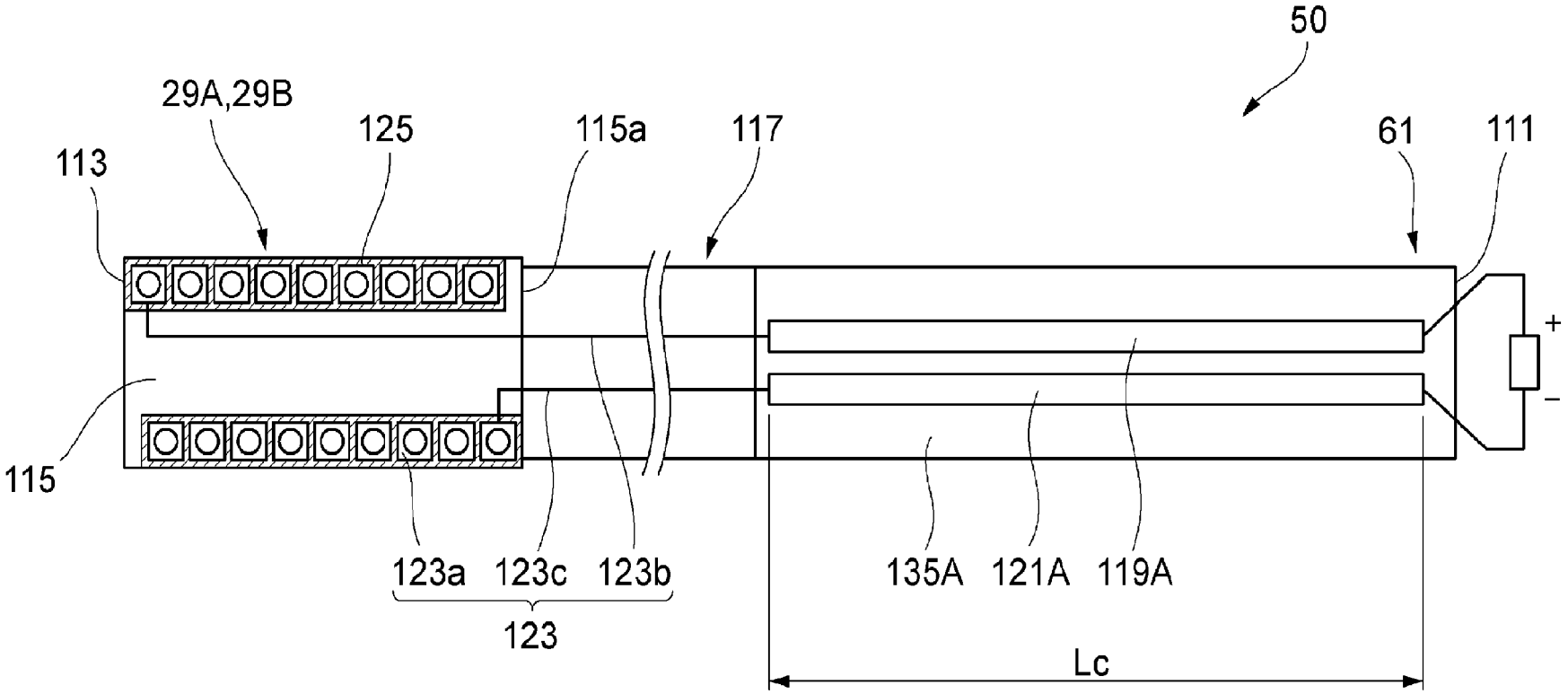
FIG. 21 is a schematic structural view of an electromagnetic forming coil unit according to a third structure example.

FIG. 21 is a schematic structural view of an electromagnetic forming coil unit 50 according to the third structure example.

The electromagnetic forming coil unit 50 according to this structure example includes the shaft core member 115, the insulating support 117, the conductor 123, and a coil-side terminal support portion 135A.

The coil-side terminal support portion 135A is formed to be longer in the axial direction than that in the electromagnetic forming coil unit 30 according to the first structure example (see FIG. 4), and a pair of long coil-side terminals 119A and 121A are disposed in the long coil-side terminal support portion 135A. Each of the coil-side terminals 119A and 121A is in the form of a plate extending in the longitudinal direction of the electromagnetic forming coil unit 50 and has an axial length Lc. Furthermore, the coil-side terminals 119A and 121A have upper surfaces being formed flat over an entire terminal length and exposed.

The electromagnetic forming coil unit 50 is movably supported by a coil moving mechanism in the axial direction as in the support structure using the coil moving mechanism 37A, 37B illustrated in FIGS. 12A to 12C. However, a terminal connection portion according to this structure example is kept stationary at a fixed position in the axial direction unlike the terminal connection portion 61A, 61B, illustrated in FIGS. 12A to 12C, which are moved together with the movement of the coil moving mechanism 37A, 37B.

Figure 22:
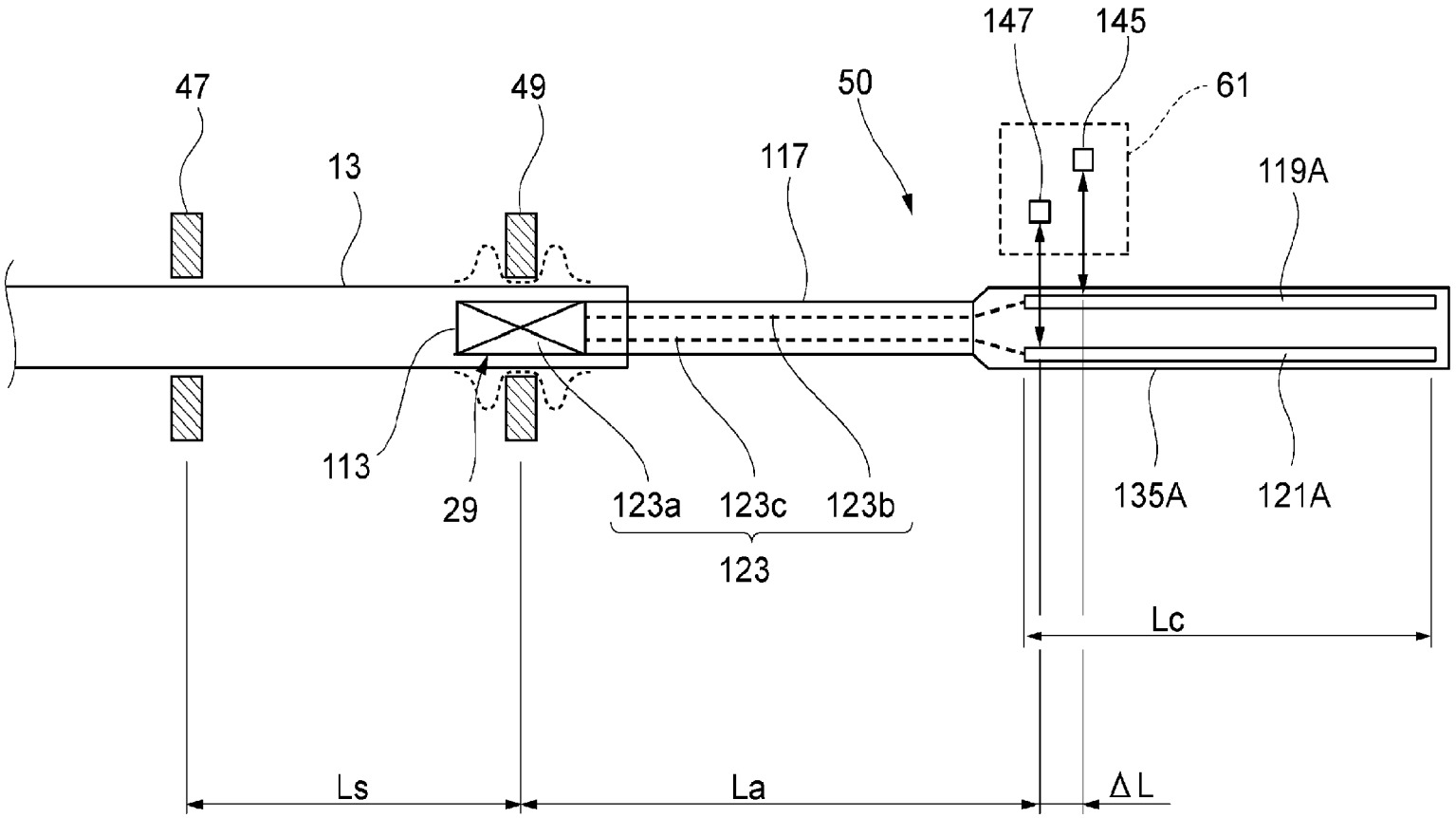
FIG. 22 is a step explanatory view schematically illustrating a tube expansion step by the electromagnetic forming coil unit.
Figure 23:
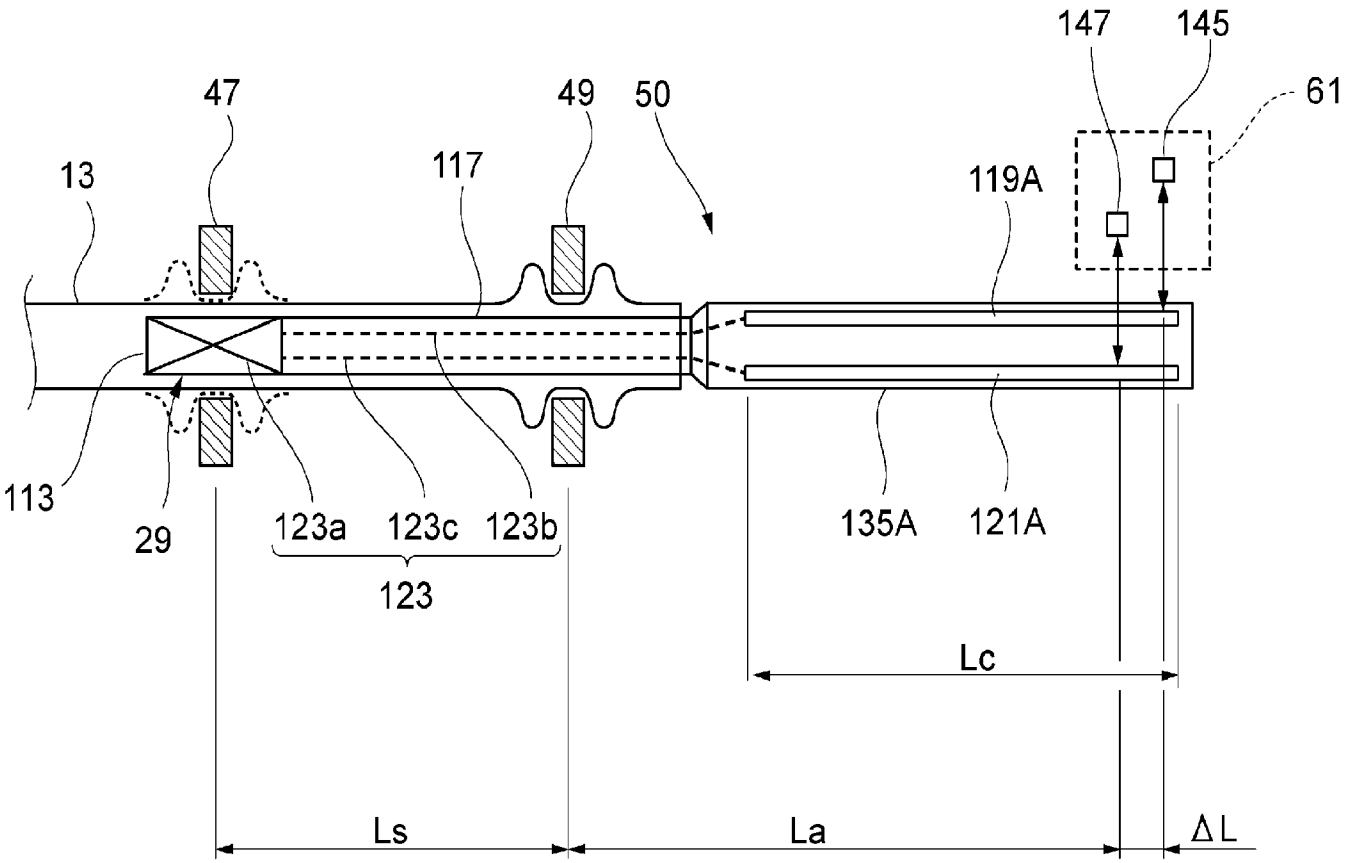
FIG. 23 is a step explanatory view schematically illustrating the tube expansion step by the electromagnetic forming coil unit.

FIGS. 22 and 23 are step explanatory views schematically illustrating a tube expansion step by the electromagnetic forming coil unit 50.

FIG. 22 illustrates a step of expanding the aluminum tube member 13 at the axial position of the support member 49, and FIG. 23 illustrates a step of expanding the aluminum tube member 13 at the axial position of the support member 47.

As illustrated in FIG. 22, the electromagnetic forming coil unit 50 is inserted, with its fore end 113 being ahead, into the aluminum tube member 13 by the above-described coil moving mechanism, and a coil portion constituted by a wound portion 123*a* is moved to the axial position of the support member 49.

In the state in which the coil portion is located at the position opposing to the support member 49, the coil-side terminals 119A and 121A of the coil-side terminal support portion 135A are sandwiched between the pressing member 149 and the support stand 143 as in the above-described terminal connection portion 61 illustrated in FIG. 10. Thus, the power supply-side terminals 145 and 147 are press-contacted and electrically conducted to the coil-side terminals 119A and 121A, respectively. Moreover, with the press-contacting, the electromagnetic forming coil unit 50 is fixed in the axial direction.

Then, pulse currents are supplied to the power supply-side terminals 145 and 147, and the aluminum tube member 13 is expanded by the electromagnetic forming at the position of the support member 49.

After releasing the power supply-side terminals 145 and 147 and the coil-side terminals 119A and 121A from the fixed state in the terminal connection portion 61 and separating them apart from each other, the coil portion 29 of the electromagnetic forming coil unit 50 is moved to the axial position of the support member 47 as illustrated in FIG. 23.

In the state in which the coil portion is located at the position opposing to the support member 47, the coil-side terminals 119A and 121A of the coil-side terminal support portion 135A are sandwiched between the pressing member 149 and the support stand 143 in a similar manner to that described above. At that time, because the power supply-side terminals 145 and 147 are kept at the same positions in the axial direction, they come into contact with the coil-side terminals 119A and 121A at different positions from those in the above case. Thus, the power supply-side terminals 145 and 147 are press-contacted and electrically conducted to the coil-side terminals 119A and 121A again, respectively. Moreover, with the press-contacting, the electromagnetic forming coil unit 50 is fixed in the axial direction.

Then, pulse currents are supplied to the power supply-side terminals 145 and 147, and the aluminum tube member 13 is expanded by the electromagnetic forming at the position of the support member 37. In such a manner, a formed article having been expanded as illustrated in FIG. 13B is obtained.

Figure 24:
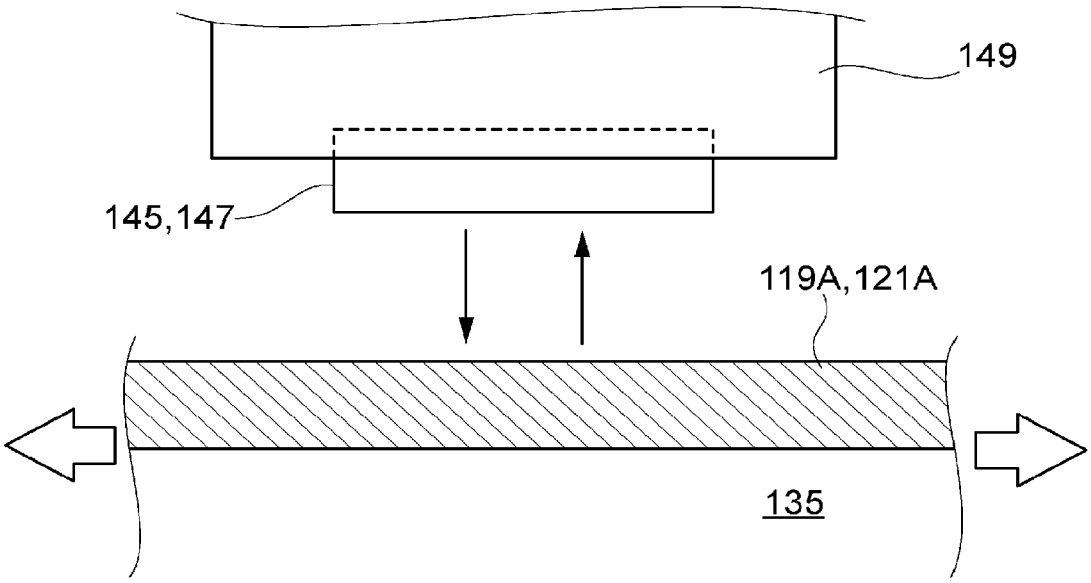
FIG. 24 is a schematic structural view illustrating a state in which a power supply-side terminal using a plate-shaped electrode terminal is in contact with a coil-side terminal.

Here, as illustrated in FIG. 24, the power supply-side terminals 145 and 147 are flat-plate electrode terminals fixed to the pressing member 149, and surfaces of the power supply-side terminals 145 and 147 opposing to the coil-side terminals 119A and 121A are formed as flat surfaces. When the power supply-side terminals 145 and 147 and the coil-side terminals 119A and 121A are press-contacted to each other in the terminal connection portion 61, the occurrence of a short circuit or a spark during the energization is suppressed because both the terminals contact each other over a large area.

Each of the coil-side terminals 119A and 121A has an axial length Lc not shorter than a distance Ls through which the electromagnetic forming coil unit 50 is moved ($Lc \geq Ls$). In other words, each of the coil-side terminals 119A and 121A has an axial length not shorter than a maximum travel distance of the electromagnetic forming coil unit 50. Accordingly, the coil-side terminals 119A and 121A and the power supply-side terminals 145 and 147 can be connected to each other, respectively, regardless of to which position the electromagnetic forming coil unit 50 is moved within its movable range. Hence the coil can be located with a high degree of freedom without restricting a region where the electromagnetic forming can be performed.

Furthermore, while remaining at the same positions, the power supply-side terminals 145 and 147 are connected to and separated from the coil-side terminals 119A and 121A. This eliminates the necessity of moving the high-voltage power supply cables connected to the power supply-side terminals 145 and 147 when the forming position is changed. Because the high-voltage power supply cables are less flexible and have large weights, there is a possibility that the cables may be worn or damaged when dragged and moved. According to this structure example, however, the necessity of moving the cables no longer exists and the step of moving the electromagnetic forming coil unit is simplified. It is hence possible to improve workability and to increase durability of the electromagnetic forming apparatus.

In addition, since the electromagnetic forming coil unit 50 is firmly fixed in the axial direction during the tube expansion by the electromagnetic forming, stable electromagnetic forming can be performed without causing position deviations.

<Modification 1>

The above-described power supply-side terminals 145 and 147 of contact and separation type may be constituted by using disk-shaped electrode terminals without being limited to the plate-shaped electrode terminals.

Figure 25:
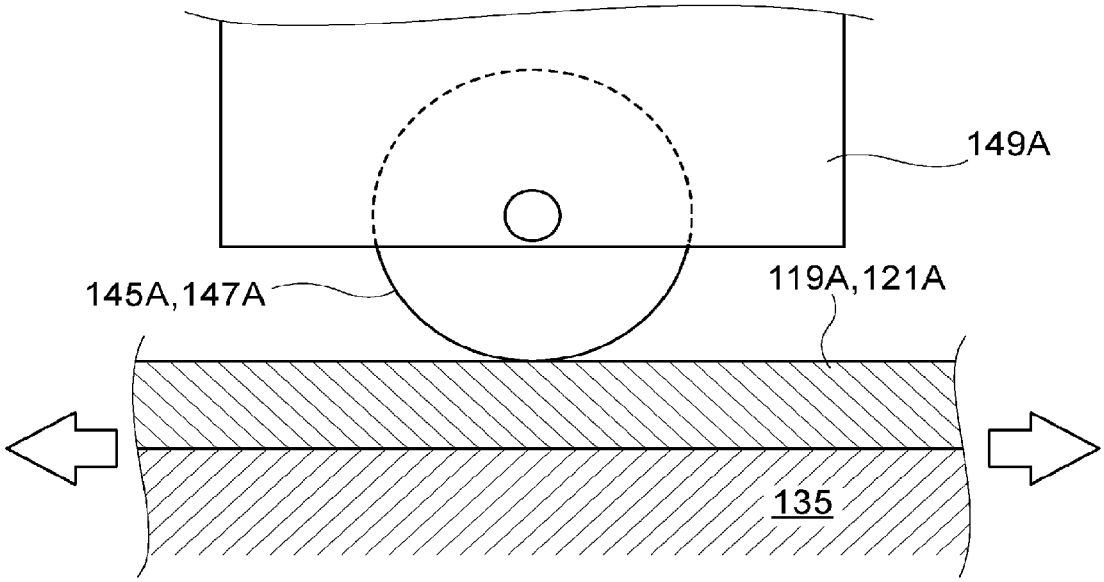
FIG. 25 is a schematic structural view illustrating a state in which a power supply-side terminal using a disk-shaped electrode terminal is in contact with the coil-side terminal.

FIG. 25 is a schematic structural view illustrating a state in which a power supply-side terminal 145A, 147A using a disk-shaped electrode terminal is in contact with the coil-side terminal 119A, 121A.

The power supply-side terminal 145A, 147A is a disk-shaped electrode terminal rotatably supported and undergoes rolling contact with the coil-side terminal 119A, 121A. This enables the electromagnetic forming coil unit 50 to be moved to plural forming positions while the power supply-side terminal 145A, 147A and the coil-side terminal 119A, 121A are held in a contact state between the terminals. Accordingly, when the electromagnetic forming coil unit 50 is moved in the axial direction as illustrated in FIGS. 22 and 23, the coil-side terminal 119A, 121A is moved to the next forming position while contacting the power supply-side terminal 145A, 147A. At each forming position, a not-illustrated fixing mechanism may be disposed to restrict the axial movement of the electromagnetic forming coil unit 50, or the axial movement of the electromagnetic forming coil unit 50 may be restricted by increasing clamping force applied in the terminal connection portion 61, 61A, 61B illustrated in FIGS. 10 and 17.

Moreover, since the electromagnetic forming coil unit 50 is moved while being pressed by the power supply-side terminals 145A and 147A, it is stably supported even during the movement. As a result, in comparison with the case of using the power supply-side terminals of contact and separation type, the axial movement of the electromagnetic forming coil unit 50 can be smoothly performed with good workability, and high positioning accuracy can easily be obtained.

The disk-shaped electrode terminal may be in the form of, in addition to a single disk, a combination of plural disks or an arrangement including plural rows of disks. Such a configuration can provide the effect, of increasing a contact area or reducing movement, resistance, and the effect, of suppressing the occurrence of a short, circuit, or a spark during the energization.

<Modification 2>

Figure 26:
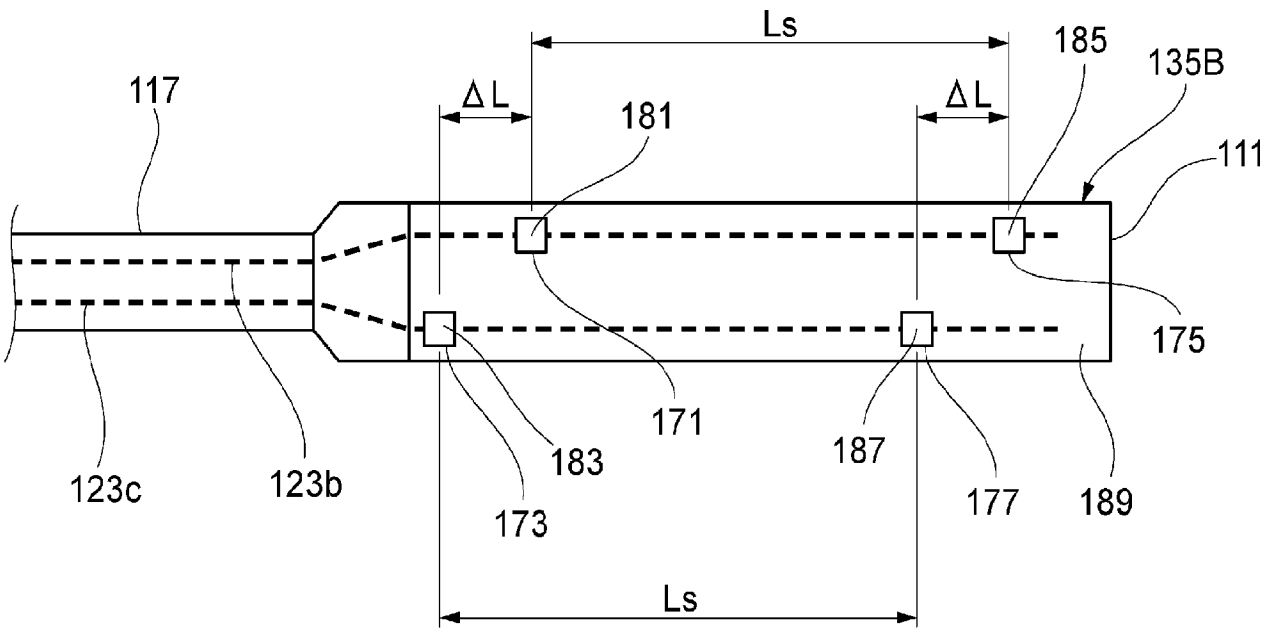
FIG. 26 is a schematic structural view illustrating another structure example of the electromagnetic forming coil unit.

FIG. 26 is a schematic structural view illustrating another structure example of the electromagnetic forming coil unit.

A coil-side terminal support portion 135B in the electromagnetic forming coil unit according to this structure example includes a pair of contact windows 171 and 173 formed on the one end side closer to the insulating support 117 and a pair of contact windows 175 and 177 formed on the side closer to the base end 111.

Coil-side terminals 181 and 185 connected to the conductor extension portion 123*b* are disposed respectively in the contact windows 171 and 175, and coil-side terminals 183 and 187 connected to the conductor extension portion

123*c* are disposed respectively in the contact windows 173 and 177. The coil-side terminals 181 and 185 are arranged at different positions along the conductor extension portion 123*b*, and the coil-side terminals 183 and 187 are arranged at different positions along the conductor extension portion 123*c*. A surface of the coil-side terminal support portion 135B where the contact windows 171, 173, 175 and 177 are formed is covered with an electrically insulating layer 189 except for regions corresponding to the contact windows 171, 173, 175 and 177.

The contact windows 171 and 173 on the side closer to the insulating support 117 are disposed at positions corresponding to the supply-side terminals 145 and 147 illustrated in FIGS. 22 and 23, and those windows are spaced from each other in the axial direction through a distance ΔL for the purpose of increasing insulating properties. Similarly, the contact windows 175 and 177 on the side closer to the base end 111 are disposed at positions corresponding to the supply-side terminals 145 and 147, and those windows are spaced from each other in the axial direction through the distance ΔL.

Furthermore, the contact window 171 and the contact window 175 are spaced from each other in the axial direction through the same distance Ls as that between the support member 47 and the support member 49 illustrated in FIGS. 22 and 23. Similarly, the contact window 173 and the contact window 177 are spaced from each other in the axial direction through the distance Ls.

In the above-described electromagnetic forming coil unit, when the aluminum tube member 13 is expanded at the axial position of the support member 49 illustrated in FIG. 22, the contact windows 171 and 173 are arranged at axial positions opposing to the supply-side terminals 145 and 147, respectively. Thus, the contact windows 171 and 173 serve as portions for connection to the coil-side terminals 119A and 121A. Moreover, when the aluminum tube member 13 is expanded at the axial position of the support member 47 illustrated in FIG. 23, the contact windows 175 and 177 are arranged at the axial positions opposing to the supply-side terminals 145 and 147, respectively, and serve as portions for connection to the coil-side terminals 119A and 121A.

Thus, the supply-side terminals 145 and 147 in this modification can be kept, as illustrated in FIGS. 22 and 23, remaining at the positions spaced from the support member 49 through a distance La in the axial direction regardless of the tube expansion position. In other words, there is no necessity of moving the supply-side terminals 145 and 147 in the axial direction depending on change of the tube expansion position. As a result, the electromagnetic forming can be continuously performed at plural positions along the axial direction while the high-voltage power supply cables connected to the supply-side terminals 145 and 147 are kept stationary, whereby efficiency in the step of performing the tube expansion at the plural positions can be increased.

The present invention is not limited to the above-described embodiments. Combinations of various components of the embodiments, and alterations and applications made by those skilled in the art on the basis of the statement of this Description and the known techniques are conceivable in relation to the present invention and fall within the scope to be protected.

This application is based on Japanese Patent Application (Patent Application 2017-136636) filed Jul. 12, 2017 and Japanese Patent Application (Patent Application 2018-21085) filed Feb. 8, 2018, the contents of which are incorporated herein by reference.

REFERENCE SIGNS LIST

13 aluminum tube member
29A first electromagnetic forming coil portion (coil portion)
29B second electromagnetic forming coil portion (coil portion)
29C third electromagnetic forming coil portion (coil portion)
29D fourth electromagnetic forming coil portion (coil portion)
30, 40, 50 electromagnetic forming coil unit
30A first coil unit (electromagnetic forming coil unit)
30B second coil unit (electromagnetic forming coil unit)
30C third coil unit (electromagnetic forming coil unit)
30D fourth coil unit (electromagnetic forming coil unit)
43, 45, 47, 49 support member (rigid member)
111 base end
113 fore end
115 shaft core member
117, 117A, 117B insulating support
119, 119A, 121, 121A, 153, 155, 181, 183, 185, 187 coil-side terminal (terminal)
123, 124 conductor
123*a*, 124*a* wound portion
123*b*, 123*c*, 124*b*, 124*c* conductor extension portion
125 resin covering layer
127, 129 groove (conductor holding portion)
145, 147, 145A, 147A power supply-side terminal (terminal on connection counterpart side)
157, 159 groove (conductor holding portion)

The invention claimed is:

1. An electromagnetic forming coil unit configured to extend in a longitudinal direction from a base end toward a fore end, inserted into a tubular member with the fore end being ahead, and used to expand the tubular member by electromagnetic force, the electromagnetic forming coil unit comprising:

a shaft core member made of a resin;

a conductor including a wound portion wound over a periphery of the shaft core member, and a pair of conductor extension portions extending from the wound portion toward the base end;

an insulating support disposed on at least one end of the shaft core member in the axial direction and extending in the longitudinal direction;

a resin covering layer covering an outer peripheral surface of the wound portion of the conductor; and a pair of conductor holding portions respectively holding the pair of conductor extension portions spaced apart from each other, the pair of conductor holding portions are positioned in the insulating support along the longitudinal direction, wherein the conductor is a tubular conductor, wherein a terminal is connected to a base-end-side end of respectively each of the pair of conductor extension portions, and wherein the terminal is a plate-shaped terminal.

2. An electromagnetic forming coil unit configured to extend in a longitudinal direction from a base end toward a fore end, inserted into a tubular member with the fore end being ahead, and used to expand the tubular member by electromagnetic force, wherein the electromagnetic forming coil unit includes a plurality of coil portions separately disposed along the longitudinal direction, each of the coil portions comprising:

a shaft core member made of a resin;

a conductor including a wound portion wound over a periphery of the shaft core member, and a pair of conductor extension portions extending from the wound portion toward the base end; and a resin covering layer covering an outer peripheral surface of the wound portion of the conductor, wherein insulating supports are disposed along the longitudinal direction between adjacent two of the coil portions and between the base end and a base-end-side end of the shaft core member in the coil portion disposed closest to the base end side, and wherein a pair of conductor holding portions respectively holding the pair of conductor extension portions spaced apart from each other, the pair of conductor holding portions are positioned in the insulating support along the longitudinal direction wherein the conductor is a tubular conductor, wherein a terminal is connected to a base-end-side end of respectively each of the pair of conductor extension portions, and wherein the terminal is a plate-shaped terminal.

3. The electromagnetic forming coil unit according to claim 1, wherein the conductor extension portion is formed to extend from the insulating support toward the base end, and the terminal is formed to extend in the longitudinal direction.

4. The electromagnetic forming coil unit according to claim 1, wherein the conductor extension portion is formed to extend from the insulating support toward the base end, and the terminal is disposed at each of plural positions along the longitudinal direction.

5. A formed-article producing method using the electromagnetic forming coil unit according to claim 1, the method successively executing:

a tubular member placement step of placing the tubular member at a processing position;

a coil placement step of inserting the electromagnetic forming coil unit into the tubular member and placing the wound portion of the conductor at a tube expansion position of the tubular member; and a tube expansion step of expanding the tubular member at the tube expansion position by electromagnetic force generated by supplying a current to the conductor in the electromagnetic forming coil unit.

6. A formed-article producing method using the electromagnetic forming coil unit according to claim 2, the method successively executing:

a tubular member placement step of placing the tubular member at a processing position;

a coil placement step of inserting the electromagnetic forming coil unit into the tubular member and placing the wound portions of the conductors at different tube expansion positions of the tubular member; and a tube expansion step of expanding the tubular member at the tube expansion positions by electromagnetic force generated by supplying currents to the conductors in the electromagnetic forming coil unit.

7. The formed-article producing method according to claim 5, wherein the tubular member placement step includes a step of placing a rigid member around the tubular member at the tube expansion position, the rigid member surrounding the tubular member in a circumferential direction.

8. The formed-article producing method according to claim 5, wherein, after the tube expansion step, the electromagnetic forming coil unit is moved in the longitudinal direction to place the wound portion of the conductor at a next tube expansion position different from the previous tube expansion position, and the tube expansion step is executed again.

9. The formed-article producing method according to claim 7, wherein the tubular member placement step includes a step of placing a rigid member around the tubular member at the tube expansion position, the rigid member surrounding the tubular member in a circumferential direction.

10. The formed-article producing method according to claim 8, wherein, in the coil placement step, the electromagnetic forming coil unit is inserted into the tubular member from each of both axial ends thereof.

11. The formed-article producing method according to claim 9, wherein, in the coil placement step, the electromagnetic forming coil unit is inserted into the tubular member from each of both axial ends thereof.

* * * * *